US008142000B2

(12) United States Patent
Ishizawa et al.

(10) Patent No.: US 8,142,000 B2
(45) **Date of Patent: *Mar. 27, 2012**

(54) LIQUID CONTAINER AND REMANUFACTURING METHOD OF LIQUID CONTAINER

(75) Inventors: Taku Ishizawa, Nagano-ken (JP); Satoshi Shinada, Nagano-ken (JP); Chiaki Miyajima, Nagano-ken (JP); Akihisa Wanibe, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 296 days.

This patent is subject to a terminal disclaimer.

(21) Appl. No.: 12/490,985

(22) Filed: Jun. 24, 2009

(65) Prior Publication Data

US 2009/0322839 A1 Dec. 31, 2009

(30) Foreign Application Priority Data

Jun. 27, 2008 (JP) ..... 2008-169090

(51) Int. Cl.
*B41J 2/175* (2006.01)

(52) U.S. Cl. ..... 347/86

(58) Field of Classification Search ..... 347/7, 19, 347/49, 85, 86, 92
See application file for complete search history.

(56) References Cited

U.S. PATENT DOCUMENTS

| | | | | |
|---|---|---|---|---|
| 6,848,776 | B2 * | 2/2005 | Nishioka et al. | 347/86 |
| 7,165,835 | B2 * | 1/2007 | Ota et al. | 347/86 |
| 2008/0034712 | A1 | 2/2008 | Miyajima et al. | |
| 2008/0088652 | A1 | 4/2008 | Miyajima et al. | |
| 2008/0094456 | A1 | 4/2008 | Miyajima et al. | |
| 2009/0015644 | A1 * | 1/2009 | Shinada et al. | 347/92 |
| 2009/0322838 | A1 * | 12/2009 | Wanibe et al. | 347/86 |
| 2010/0073438 | A1 * | 3/2010 | Wanibe et al. | 347/85 |

FOREIGN PATENT DOCUMENTS

CN 101121336 A 2/2008

(Continued)

OTHER PUBLICATIONS

Office Action dated Nov. 9, 2011 in U.S. Appl. No. 12/490,935.

(Continued)

*Primary Examiner* — Anh T. N. Vo
(74) *Attorney, Agent, or Firm* — Stroock & Stroock & Lavan LLP

(57) ABSTRACT

One aspect of the invention is directed to a remanufacturing method of a liquid container constructed to store a liquid, which is to be supplied to a liquid ejection device. The remanufacturing method provides the liquid container structured to include: a liquid reservoir assembly configured to store the liquid; a liquid feeder configured to supply the liquid stored in the liquid reservoir assembly to the liquid ejection device; a sensor unit located in the upstream of the liquid feeder and configured to detect a level of the liquid stored in the liquid container; and a bubble trap module located in the upstream of the sensor unit and in the downstream of the liquid reservoir assembly and configured to trap bubbles included in the liquid. The remanufacturing method forms an inlet to communicate either with the bubble trap module or with a pathway of the liquid in the downstream of the bubble trap module. The remanufacturing method injects the liquid through the inlet, and seals the inlet after the injection of the liquid. This arrangement enables the liquid to be readily and efficiently refilled into the liquid container without damaging the functions of the liquid container.

14 Claims, 21 Drawing Sheets

FOREIGN PATENT DOCUMENTS

| | | | |
|---|---|---|---|
| EP | 1 886 823 | A2 | 2/2008 |
| JP | 2007-508160 | | 4/2007 |
| JP | 2008-044184 | | 2/2008 |
| JP | 2008-044185 | | 2/2008 |
| JP | 2008-044186 | | 2/2008 |
| JP | 2008-044190 | | 2/2008 |
| JP | 2008-044192 | | 2/2008 |
| JP | 2008-044193 | | 2/2008 |
| JP | 2008-044195 | | 2/2008 |
| JP | 2008-044198 | | 2/2008 |
| JP | 2008-068614 | | 3/2008 |
| WO | WO 2005032825 | | 4/2005 |

OTHER PUBLICATIONS

Office Action dated Jul. 12, 2011 in U.S. Appl. No. 12/490,935.
Office Action dated Jul. 8, 2011 in U.S. Appl. No. 12/490,876.
Office Action dated Nov. 8, 2011 received in U.S. Appl. No. 12/490,876.

* cited by examiner

LIQUID CONTAINER AND REMANUFACTURING METHOD OF LIQUID CONTAINER

CROSS-REFERENCE TO RELATED APPLICATION

The present application claims priority from Japanese application P2008-169090A filed on Jun. 27, 2008, the contents of which are hereby incorporated by reference into this application.

BACKGROUND

1. Field of the Invention

The present invention relates to a liquid container structured to store a liquid, which is to be supplied to a liquid ejection device, as well as a remanufacturing method of such a liquid container.

2. Description of the Related Art

In ink-jet printers, in response to detection of out-of-ink with consumption of ink stored in an ink cartridge, the used ink cartridge is generally replaced with a new ink cartridge. As ink cartridges are recycled, more active approaches for the more efficient use of resources have been demanded and discussed. One approach refills ink into the used ink cartridge. Some techniques have been proposed for ink refill in the ink cartridge as disclosed in, for example, Japanese Patent Laid-Open No. 2007-508160.

The ink refill technique disclosed in this cited reference seals an ink outlet of the ink cartridge with a plug, drills or otherwise bores a through hole in the outer wall surface of the ink cartridge, refills ink via the through hole into an ink reservoir assembly by means of an injector, and seals the through hole after the ink refill. This prior art ink refill technique expects the air remaining in the ink cartridge to be naturally discharged out via the through hole designed to have a larger diameter than the diameter of the injector during the ink refill.

The ink refill technique disclosed in the cited reference seals the ink outlet and causes the air remaining in the ink cartridge to be discharged out via the through hole during the ink refill as mentioned above. This structure interferes with the ink flowing into a pathway between the ink reservoir assembly and the ink outlet and accordingly does not attain the efficient ink refill. The ink refill technique of the cited reference is not simply applicable to ink cartridges of the complicated and advanced internal structure. For example, in an ink cartridge equipped with a sensor unit including an ink sensor that utilizes a piezoelectric element to detect the level of remaining ink, the ink flow path structure is especially complicated to avoid false detection of the ink sensor caused by migration of the air into the sensor unit. It is thus very difficult to select an adequate position for formation of the through hole. Formation of the through hole at an inadequate position may damage the functions of the ink cartridge. Formation of the through hole may also cause the air to be migrated into the ink sensor provided between the ink reservoir assembly and the ink outlet. Such air migration into the ink sensor may cause false detection of the ink sensor and may further lead to migration of the air into a print head of a printer to cause a trouble of the print head.

This problem is not characteristic of the ink cartridge for the printer but is commonly found in diversity of liquid containers used for supplying a liquid to a liquid ejection device, for example, a liquid container for supplying a metal-containing liquid material to an injection device designed to inject the liquid material onto a semiconductor substrate and thereby form an electrode layer on the semiconductor substrate.

SUMMARY

By taking into account the drawbacks discussed above, there would be a demand for easily and efficiently refilling a liquid into a liquid container without damaging the functions of the liquid container. The present invention accomplishes at least part of the demand mentioned above and the other relevant demands by variety of configurations discussed below.

One aspect of the invention is directed to a remanufacturing method of a liquid container constructed to store a liquid, which is to be supplied to a liquid ejection device. The remanufacturing method provides the liquid container structured to include: a liquid feeder configured to supply the liquid, which is stored in a liquid reservoir assembly used for storage of the liquid, to the liquid ejection device; a sensor unit located at a specific position between the liquid reservoir assembly and the liquid feeder and configured to detect a level of the liquid stored in the liquid container; and a bubble trap module located at a specific position between the liquid reservoir assembly and the sensor unit and configured to trap bubbles included in the liquid. The remanufacturing method forms an inlet to be open to outside of the liquid container and to communicate either with the bubble trap module or with a pathway of the liquid provided at a specific position between the bubble trap module and the liquid feeder. The remanufacturing method injects the liquid through the inlet, and seals the inlet after the injection of the liquid.

The remanufacturing method of the liquid container according to this aspect of the invention forms the inlet either in the bubble trap module or in the pathway of the liquid in the downstream of the bubble trap module to allow external injection of the liquid. The liquid is thus injected into the liquid reservoir assembly in the upstream of the inlet, after being sufficiently filled in the downstream of the bubble trap module. This arrangement effectively removes bubbles from the sensor unit and the bubble trap module and thereby decreases the potential for false detection of the sensor unit that falsely detects the out-of-liquid although the liquid actually remains in the liquid container. The liquid container of this structure desirably prevents migration of bubbles into the liquid ejection device and thus decreases the potential troubles in the liquid ejection device due to migration of bubbles.

In one preferable application according to the above aspect of the invention, the remanufacturing method provides the liquid container structured to further include: a connection flow path arranged to have an upstream section connecting with the liquid reservoir assembly and a downstream section connecting with the bubble trap module and defined by multiple through holes formed to pass through a container body of the liquid container from one face to the other face and have ends respectively interconnected and by films designed to seal both ends of the multiple through holes.

The connection flow path effectively prevents migration of bubbles in the downstream of the bubble trap module. The connection flow path is readily produced by the combination of the multiple through holes and the sealing films. This arrangement ensures the sufficient flow path length of the connection flow path in a space-saving manner, while effectively preventing migration of bubbles in the downstream of the bubble trap module.

In one preferable embodiment of the remanufacturing method of the above application, the multiple through holes defining the connection flow path are formed to have a turn-down like a dog-leg stair from upstream to downstream of the connection flow path.

This arrangement ensures the sufficient flow path length of the connection flow path in a space-saving manner, while effectively preventing migration of bubbles in the downstream of the bubble trap module, irrespective of the attitude of the liquid container.

In the remanufacturing method of the above embodiment, the multiple through holes may be formed to be extended in a substantially horizontal direction and to be arranged in zigzag along a vertical direction in a state of attachment of the liquid container to the liquid ejection device.

This arrangement ensures the sufficient flow path length of the connection flow path in a more space-saving manner.

In another preferable application according to the above aspect of the invention, the remanufacturing method provides the liquid container structured to further include: an air open structure located in the upstream of the liquid reservoir assembly and formed to introduce the outside air to inside of the liquid container accompanied with consumption of the liquid stored in the liquid reservoir assembly, and sucks the air through the air open structure out of the liquid reservoir assembly.

The liquid is injected after pressure reduction of the liquid reservoir assembly by suction of the air through the air open structure out of the liquid reservoir assembly. This arrangement ensures quick injection of the liquid into the liquid container, while effectively removing bubbles from the sensor unit and the bubble trap module.

In still another preferable application according to the above aspect of the invention, the remanufacturing method sucks the air through the liquid feeder out of the liquid reservoir assembly.

This arrangement enables the liquid to be quickly filled into the liquid feeder.

In another preferable application according to the above aspect of the invention, the remanufacturing method provides the liquid container structured to further include: a backflow check structure located at a specific position between the sensor unit and the liquid feeder and configured to prevent backflow of the liquid toward the sensor unit. The remanufacturing method forms the inlet to communicate either with the bubble trap module or with a pathway of the liquid extended from the bubble trap module to the backflow check structure, and injects the liquid through the inlet to a specific position between the bubble trap module and the backflow check structure. The remanufacturing method of this application further sucks in the liquid feeder to fill a space from the backflow check structure to the liquid feeder with the liquid.

This arrangement enables the liquid to be refilled into the liquid container equipped with the backflow check structure, while preventing migration of bubbles into the sensor unit and thereby into the liquid ejection device.

In a further preferable application according to the above aspect of the invention, the remanufacturing method provides the liquid container structured to further include: a buffer module located in a pathway from the sensor unit to the liquid feeder and configured to temporarily reserve the liquid, and forms the inlet to communicate with the buffer module.

This arrangement enables the liquid to be refilled into the liquid container equipped with the backflow check structure, while preventing migration of bubbles into the sensor unit and thereby into the liquid ejection device.

In another preferable application according to the above aspect of the invention, the remanufacturing method seals the inlet by insertion of an elastic member into the inlet.

This arrangement easily seals the inlet and enables the liquid to be readily refilled into the liquid container by simply removing the elastic member.

In still another preferable application according to the above aspect of the invention, the remanufacturing method provides the liquid container structured to further include: a cover member configured to cover over a wall surface defining either the bubble trap module or the pathway of the liquid provided at the specific position between the bubble trap module and the liquid feeder. The remanufacturing method first forms a hole in the cover member to be greater in dimensions than the inlet, and subsequently forms the inlet in the wall surface.

This arrangement enables the liquid to be readily refilled into the liquid container without requiring removal of the cover member.

In one preferable embodiment according to the above aspect of the invention, the remanufacturing method provides the liquid container structured to further include: a memory configured to store information on a consumed amount of the liquid stored in the liquid container. The remanufacturing method rewrites the information on the consumed amount of the liquid stored in the memory.

Rewriting the information on the consumed amount of the liquid stored in the memory to an adequate value enables the liquid container with refill of the liquid to be used for the liquid ejection device without causing a trouble.

In another preferable embodiment according to the above aspect of the invention, the remanufacturing method provides the liquid container structured to further include: a memory configured to store information on a consumed amount of the liquid stored in the liquid container. The remanufacturing method replaces the memory.

Replacing the memory enables the liquid container with refill of the liquid to be used for the liquid ejection device without causing a trouble.

According to another aspect, the invention is also directed to a liquid container constructed to store a liquid, which is to be supplied to a liquid ejection device. The liquid container includes: a liquid reservoir assembly configured to store the liquid; a liquid feeder configured to supply the liquid to the liquid ejection device; a sensor unit located at a specific position between the liquid reservoir assembly and the liquid feeder and configured to detect a level of the liquid stored in the liquid container; a bubble trap module located at a specific position between the liquid reservoir assembly and the sensor unit and configured to trap bubbles included in the liquid; an inlet configured to communicate either with the bubble trap module or with a pathway of the liquid provided at a specific position between the bubble trap module and the liquid feeder and to allow external injection of the liquid; and a sealing member structured to seal the inlet.

The liquid container according to this aspect of the invention has the similar effects to those of the remanufacturing method of the liquid container discussed above. Sealing the inlet with the sealing member does not cause any inlet-induced troubles. The liquid container of this structure is readily refilled with the liquid injected through the inlet by simply removing the sealing member.

According to still another aspect, the invention is further directed to a liquid container constructed to be attachable to and detachable from a liquid ejection device and to store a liquid, which is to be supplied to the liquid ejection device. The liquid container includes: a liquid reservoir assembly configured to store the liquid; a liquid feeder configured to supply the liquid to the liquid ejection device; a sensor unit located at a specific position in a pathway of the liquid between the liquid reservoir assembly and the liquid feeder and configured to detect a level of the liquid stored in the liquid container; and a bubble trap module located at a specific position between the liquid reservoir assembly and the sensor unit and configured to trap bubbles included in the liquid. The bubble trap module is filled with a specific amount of the liquid that enables bubbles migrated into the bubble trap module to be trapped.

In the liquid container of this structure, the bubble trap module has the bubble trapping function. This arrangement effectively removes bubbles from the sensor unit and thereby decreases the potential for false detection of the sensor unit that falsely detects the out-of-liquid although the liquid actually remains in the liquid container.

In one preferable embodiment of the invention, the liquid container further has: an inlet configured to be open to outside of the liquid container and to communicate either with the bubble trap module or with a pathway of the liquid provided at a specific position between the bubble trap module and the liquid feeder; and a sealing member structured to seal the inlet.

The liquid container of this structure is readily refilled with the liquid injected through the inlet by simply removing the sealing member.

DESCRIPTION OF THE PREFERRED EMBODIMENTS

Figure 1:
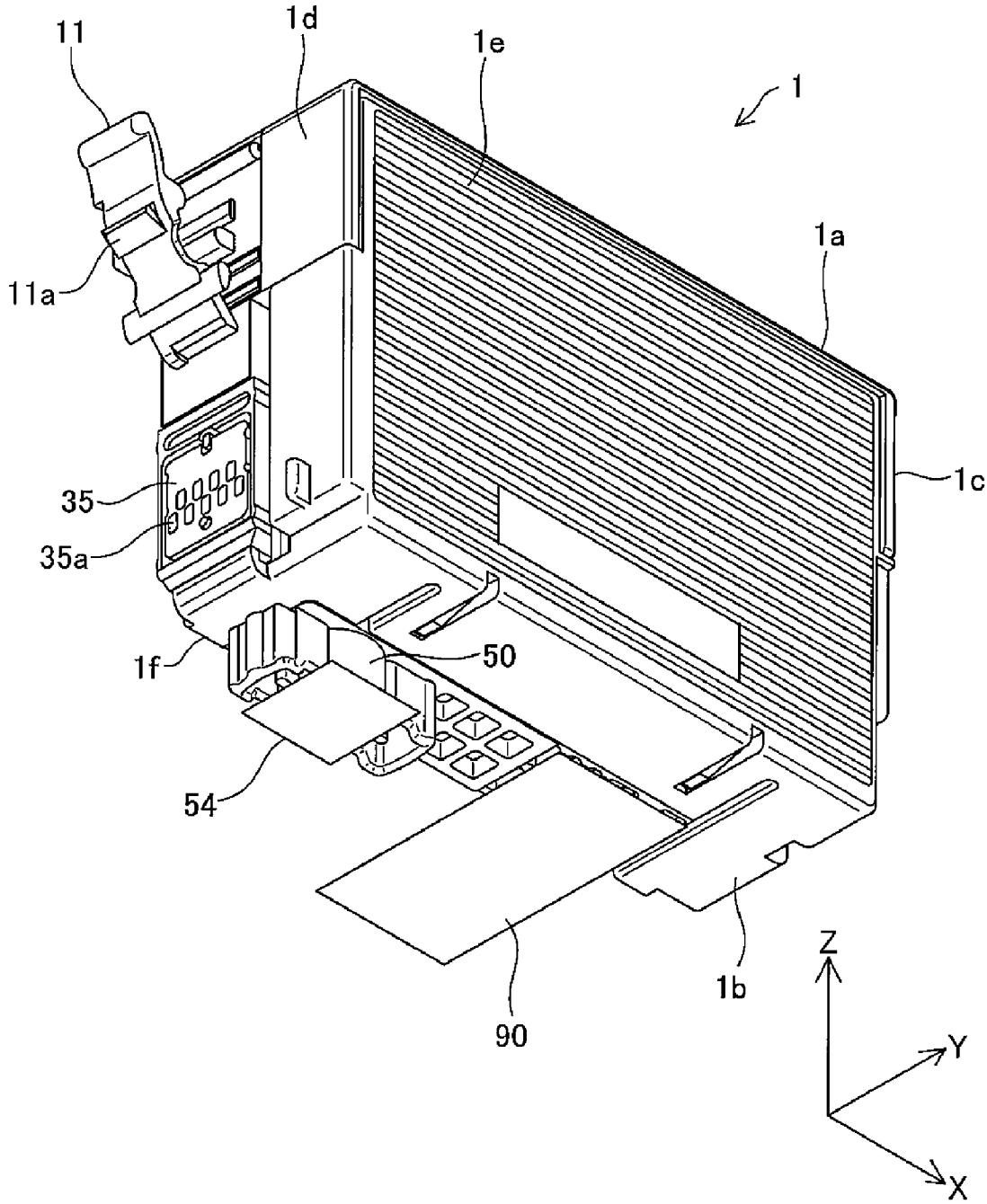
FIG. 1 is a perspective view showing the appearance of an ink cartridge used for ink refill in a first embodiment of the invention.
Figure 2:
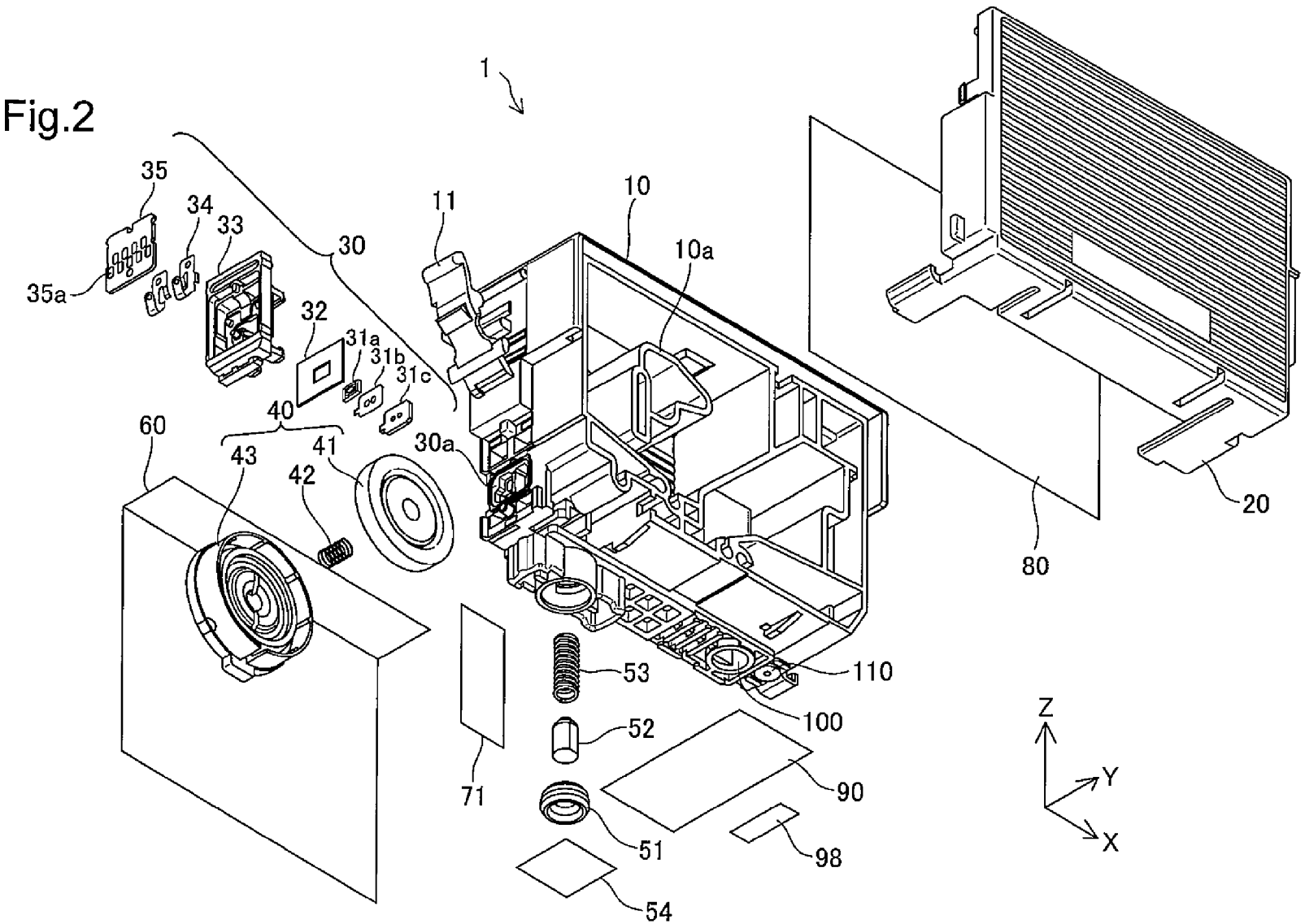
FIG. 2 is an exploded perspective view of the ink cartridge of the first embodiment shown in FIG. 1.
Figure 3:
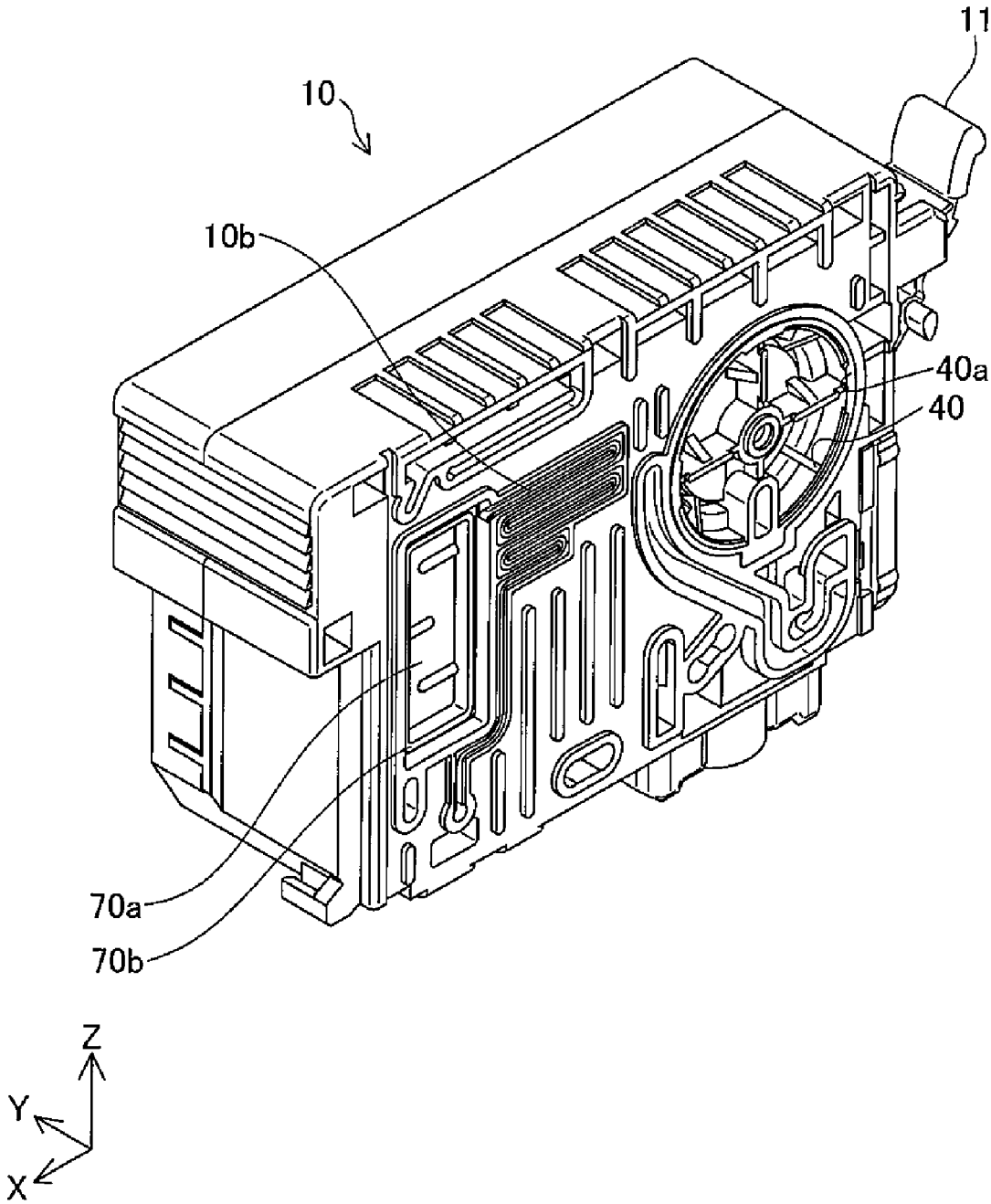
FIG. 3 is a perspective view showing the appearance of a cartridge body in the ink cartridge of the first embodiment.

A. First Embodiment a. Structure of Ink Cartridge:

FIG. 1 is a perspective view showing the appearance of an ink cartridge 1 used for ink refill in a first embodiment of the invention. FIG. 2 is an exploded perspective view of the ink cartridge 1 of the first embodiment shown in FIG. 1. FIG. 3 is a perspective view showing the appearance of a cartridge body 10 in the ink cartridge 1 of the first embodiment. In FIGS. 1 through 3, XYZ axes are shown for specifying the direction or the attitude of the ink cartridge 1. As illustrated, the ink cartridge 1 stores ink in the liquid form therein and is attached to a carriage (not shown) of an ink-jet printer to supply ink to the ink-jet printer.

As shown in FIG. 1, the ink cartridge 1 is formed in a substantially rectangular parallelepiped and has a Z-axis positive direction face 1*a*, a Z-axis negative direction face 1*b*, an X-axis positive direction face 1*c*, an X-axis negative direction face 1*d*, a Y-axis positive direction face 1*e*, and a Y-axis negative direction face 1*f*. In the description hereafter, for the sake of simplicity, the faces 1*a*, 1*b*, 1*c*, 1*d*, 1*e*, and 1*f* may also be respectively referred to as the top face, the bottom face, the right lateral face, the left lateral face, the front face, and the rear face. The sides corresponding to the faces 1*a*, 1*b*, 1*c*, 1*d*, 1*e*, and 1*f* are respectively referred to as the top side, the bottom side, the right side, the left side, the front side, and the rear side.

A liquid feeder 50 is provided on the bottom face 1*b* and has a feed hole for supplying the ink to the ink-jet printer. An air hole 100 open to the air is formed in the bottom face 1*b* to introduce the air into the ink cartridge 1 (see FIG. 2).

The air hole 100 has a specific depth and a specific diameter sufficient to receive a projection (not shown) formed on the carriage of the ink-jet printer, therein via a predetermined clearance. The user peels off a sealing film 90 that seals the air hole 100 in an air-tight manner and subsequently attaches the ink cartridge 1 to the carriage.

A catch lever 11 is provided on the left lateral face 1*d*. The catch lever 11 has a projection 11*a*. In attachment of the ink cartridge 1 to the carriage, the projection 11*h* is caught in a recess (not shown) formed in the carriage. The ink cartridge 1 is accordingly fastened to the carriage. In a printing process of the ink-jet printer, the carriage moves integrally with a print head (not shown) back and forth along a width direction of a printing medium (main scanning direction).

A circuit board 35 is provided below the catch lever 11 on the left lateral face 1*d*. The circuit board 35 has multiple electrode terminals 35*a*, which are electrically connected with the ink-jet printer via corresponding electrode terminals (not shown) on the carriage.

An outer surface film 60 is applied on the top face 1*a* and on the rear face 1*f* of the ink cartridge 1.

The ink cartridge 1 has a cartridge body 10 and a cover member 20 covering the front side (the side of the face 1*e*) of the cartridge body 10.

As shown in FIG. 2, ribs 10*a* in various shapes are formed on the front side of the cartridge body 10. A film 80 is provided between the cartridge body 10 and the cover member 20 to cover the front side of the cartridge body 10. The film 80 is closely applied onto the cartridge body 10 such as to make no spaces from the respective front ends of the ribs 10*a* on the cartridge body 10. The ribs 10*a* and the film 80 define multiple small chambers including a first liquid reservoir, a second liquid reservoir, and a buffer chamber (discussed later) inside the ink cartridge 1.

A differential pressure regulator chamber 40*a* and a gas liquid separation chamber 70*a* are formed on the rear side of the cartridge body 10. The differential pressure regulator chamber 40*a* receives a differential pressure regulator 40 including a valve member 41, a spring 42, and a spring washer 43. The gas liquid separation chamber 70*a* has a step 70*b* formed around an inner wall surrounding a bottom face. A gas liquid separating film 71 is attached to the step 70*b*. The gas liquid separating film 71 in combination with the gas liquid separation chamber 70*a* and the step 70*b* forms a gas liquid separation filter 70.

Multiple grooves 10*b* are formed on the rear side of the cartridge body 10. In application of the outer surface film 60 to cover over the substantially whole rear face of the cartridge body 10, these multiple grooves 10*b* form various flow paths (discussed later), for example, flow paths for ink and the air, between the cartridge body 10 and the outer surface film 60.

The peripheral structure of the circuit board 35 is described. A sensor chamber 30*a* (corresponding to the sensor unit in the claims of the invention) is formed in a lower area (on the side of the face 1*b*) of the right lateral face (the face 1*c*) of the cartridge body 10. A liquid level sensor 31 is placed in the sensor chamber 30*a* and is stuck by a film 32. The liquid level sensor 31 includes a piezoelectric element-containing sensor chip 31*a*, a metal sensor base member 31*c*, and an adhesive sheet 31*b* used to bond the sensor chip 31*a* to the sensor base member 31*c*. The opening of the sensor chamber 30*a* on the right lateral face is covered with a sensor cover 33. The circuit board 35 is fixed to an outer surface 33*a* of the sensor cover 33 via a trunk terminal 34. The liquid level sensor 31 in combination with the sensor chamber 30*a*, the film 32, the sensor cover 33, the trunk terminal 34, and the circuit board 35 constitutes a sensor unit 30.

The sensor chip 31*a* has a cavity arranged to form part of an ink fluid assembly (discussed later), a diaphragm arranged to form part of wall surface of the cavity, and a piezoelectric element located on the diaphragm. The detailed structure of the sensor chip 31*a* is not specifically illustrated. A terminal of the piezoelectric element is electrically connected with part of the electrode terminals 35*a* on the circuit board 35. In attachment of the ink cartridge 1 to the ink-jet printer, the terminal of the piezoelectric element is electrically connected with the ink-jet printer via the electrode terminal 35*a* of the circuit board 35. The ink-jet printer gives electrical energy to the piezoelectric element to vibrate the diaphragm via the piezoelectric element. The ink-jet printer detects the residual vibration characteristic (for example, the frequency) of the diaphragm via the piezoelectric element, so as to identify the presence or the absence of ink in the cavity. Consumption of the ink stored in the cartridge body 10 changes the internal state of the cavity from the ink filling state to the air filling state. This leads to a change of the residual vibration characteristic of the diaphragm. The change of the residual vibration characteristic is detected by the liquid level sensor 31. Based on the result of such detection, the ink-jet printer identifies the presence or the absence of the ink in the cavity.

The circuit board 35 has a rewritable non-volatile memory, such as an EEPROM (electronically erasable and programmable read only memory), to record pieces of ink-related information, such as the consumed amount of ink by the ink-jet printer.

A decompression hole 110 is provided, together with the liquid feeder 50 and the air hole 100 mentioned above, on the bottom face of the cartridge body 10. The decompression hole 110 is used to suck out the air and depressurize the inside of the ink cartridge 1 at an ink filling step in a remanufacturing process of the ink cartridge 1.

Immediately after manufacture of the ink cartridge 1, the openings of the liquid feeder 50, the air hole 100, and the decompression hole 110 are respectively sealed with sealing films 54, 90, and 98. The sealing film 90 is peeled off by the user, prior to attachment of the ink cartridge 1 to the carriage of the ink-jet printer as explained previously. The peel-off of the sealing film 90 makes the air hole 100 communicate with the outside air to allow introduction of the air into the ink cartridge 1. In the state of attachment of the ink cartridge 1 to the carriage of the ink-jet printer, the sealing film 54 is broken by an ink supply needle (not shown) provided on the carriage.

A closing spring 53, a spring washer 52, and a seal member 51 are provided inside the liquid feeder 50 to be arranged in this order from the inside to the outside. In insertion of the ink supply needle into the liquid feeder 50, the seal member 51 seals the liquid feeder 50 to make no clearance between the inner wall of the liquid feeder 50 and the outer wall of the ink supply needle. In the state of no attachment of the ink cartridge 1 to the carriage, the spring washer 52 comes into contact with the inner wall of the seal member 51 to close the liquid feeder 50. The closing spring 53 presses the spring washer 52 in a specific direction to bring the spring washer 52 into contact with the inner wall of the seal member 51. In insertion of the ink supply needle on the carriage into the liquid feeder 50, an upper edge of the ink supply needle presses up the spring washer 52 to make a clearance between the spring washer 52 and the seal member 51. A supply of ink is fed to the ink supply needle through this clearance.

Figure 4:
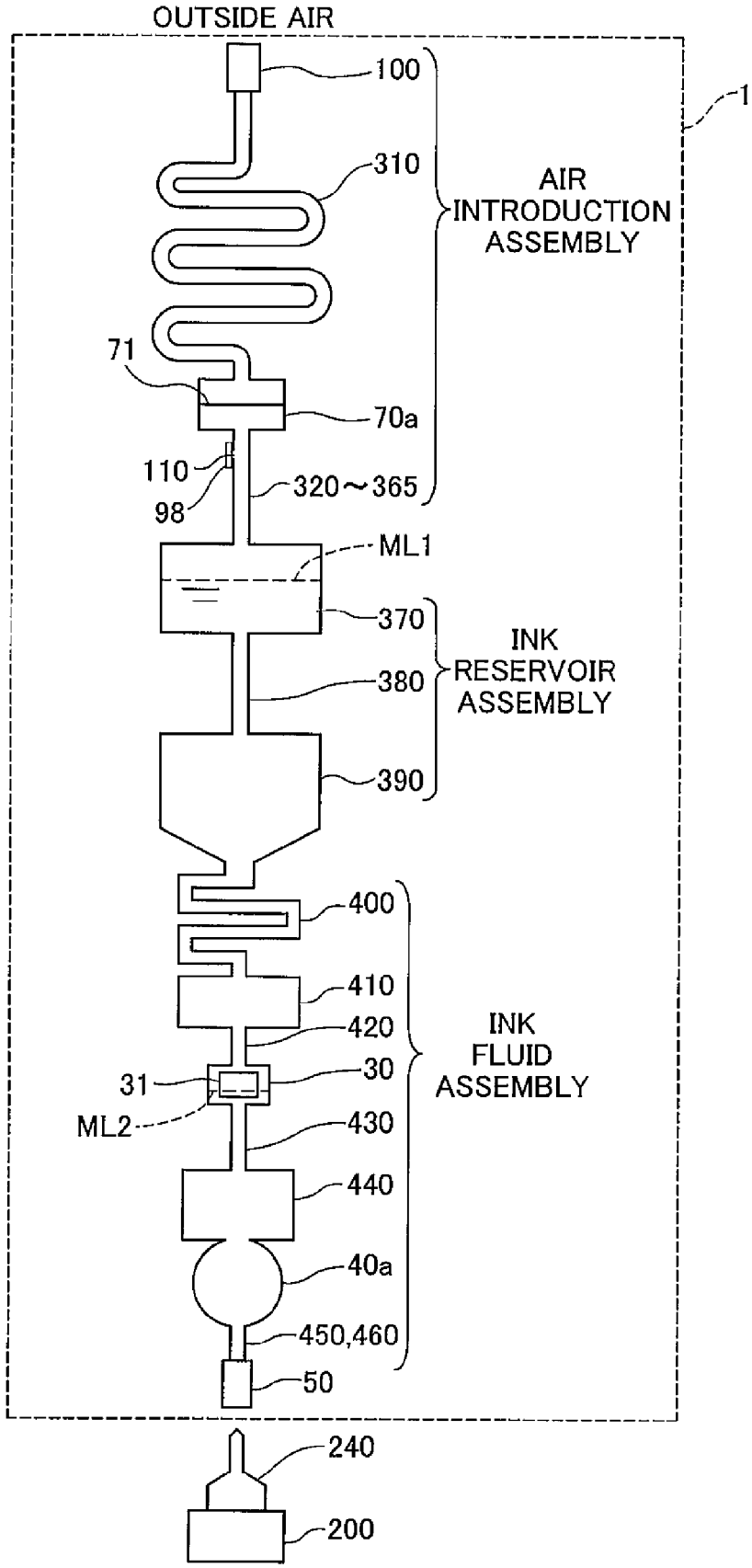
FIG. 4 is a conceptive view showing pathway from an air hole to a liquid feeder in the first embodiment.

FIG. 4 is a conceptive view showing the pathway from the air hole 100 to the liquid feeder 50 in the first embodiment. Prior to the detailed explanation of the internal structure of the ink cartridge 1, for the better understanding, the pathway from the air hole 100 to the liquid feeder 50 is conceptually discussed with reference to FIG. 4.

The pathway from the air hole 100 to the liquid feeder 50 is roughly divided into an ink reservoir assembly for storage of ink, an air introduction assembly provided in the upstream of the ink reservoir assembly, and an ink fluid assembly provided in the downstream of the ink reservoir assembly.

The air introduction assembly has the air hole 100, a serpentine path 310, the gas liquid separation chamber 70*a* provided to receive the gas liquid separating film 71 therein as discussed above, and air chambers 320 to 360 formed to connect the gas liquid separation chamber 70*a* to the ink reservoir assembly, which are arranged in this order from the upstream to the downstream. The serpentine path 310 has an upstream end connecting with the air hole 100 and a downstream end connecting with the gas liquid separation chamber 70*a*. The serpentine path 310 meanders to extend the length from the air hole 100 to the ink reservoir assembly. This arrangement desirably prevents vaporization of the water content in the ink in the ink reservoir assembly. The gas liquid separating film 71 is made of a specific material that allows transmission of gas but prohibits transmission of liquid. The gas liquid separating film 71 is provided between an upstream section and a downstream section of the gas liquid separation chamber 70*a*. This arrangement aims to prevent the backflow of the ink from the ink reservoir assembly from flowing into the upstream of the gas liquid separation chamber 70*a*. The decompression hole 110 discussed above is formed in the air chambers 320 to 360 and is externally sealed with the sealing film 98 as explained previously. The detailed structure of the air chambers 320 to 360 will be discussed later.

The ink reservoir assembly has a first liquid reservoir 370, a communicating path 380, and a second liquid reservoir 390, which are arranged in this order from the upstream to the downstream. The communicating path 380 has an upstream end connecting with the first liquid reservoir 370 and a downstream end connecting with the second liquid reservoir 390. Instead of the separate first and second liquid reservoirs 370 and 390, only one integral liquid reservoir may be provided. The first liquid reservoir 370, the second liquid reservoir 390, and the communicating path 380 are equivalent to the liquid reservoir assembly in the claims of the invention.

The ink fluid assembly has a bubble trap flow path 400, a bubble trap chamber 410, a first fluid path 420, the sensor unit 30 mentioned above, a second fluid path 430, a buffer chamber 440, the differential pressure regulator chamber 40*a* provided to receive the differential pressure regulator 40 therein as discussed above, a third fluid path 450, and a fourth fluid path 460, which are arranged in this order from the upstream to the downstream. The bubble trap flow path 400 has an upstream end connecting with the second liquid reservoir 390 and a downstream end connecting with the bubble trap chamber 410. The bubble trap flow path 400 accordingly works as a connecting pathway of connecting the second liquid reservoir 390 with the bubble trap chamber 410. The bubble trap flow path 400 is formed by a small-bore tube with multiple bends. This shape of the bubble trap flow path 400 effectively traps bubbles included in the ink and thereby prevents migration of bubbles in the downstream of the bubble trap flow path 400. The bubble trap chamber 410 introduces the ink, which is flowed from the bubble trap flow path 400 to the upstream of the bubble trap chamber 410, via the bottom side of the bubble trap chamber 410 through the second fluid path 430 to the sensor unit 30. This arrangement enables bubbles that may be invaded from the bubble trap flow path 400 to be trapped on the top side of the bubble trap chamber 410. The ink fluid assembly is structured in this manner to prevent migration of bubbles in the downstream and thereby decrease or substantially eliminate the potential for false detection by the liquid level sensor 31. The first fluid path 420 has an upstream end connecting with the bubble trap chamber 410 and a downstream end connecting with the sensor unit 30. The bubble trap chamber 410 and the bubble trap flow path 400 respectively correspond to the bubble trap module and the connection flow path in the claims of the invention.

The second fluid path 430 has an upstream end connecting with the sensor unit 30 and a downstream end connecting with the buffer chamber 440. The buffer chamber 440 directly communicates with the differential pressure regulator chamber 40*a*. The differential pressure regulator 40 located in the differential pressure regulator chamber 40*a* regulates the pressure of the ink in the downstream of the differential pressure regulator chamber 40*a* to be lower than the pressure of the ink in the upstream and causes the ink to have a negative pressure in the downstream. This arrangement effectively prevents ink drip from the print head. The third fluid path 450 has an upstream end connecting with the differential pressure regulator chamber 40*a* and a downstream end connecting with the liquid feeder 50 via the fourth fluid path 460. The differential pressure regulator chamber 40*a* corresponds to the backflow check structure in the claims of the invention.

In manufacture of the ink cartridge 1, ink is filled to the first liquid reservoir 370. The liquid level of the ink in this state is conceptually shown as a broken line ML1 in FIG. 4. As the ink stored in the ink cartridge 1 is gradually consumed by the ink-jet printer, the liquid level of the ink moves in the downstream, while the air introduced through the air hole 100 flows from the upstream into the ink cartridge 1. With further consumption of ink, the liquid level of the ink reaches the sensor unit 30. The liquid level of the ink in this state is conceptually shown as a broken line ML2 in FIG. 4. The resulting introduction of the air into the sensor unit 30 is detected as the out-of-ink by the liquid level sensor 31. In response to detection of the out-of-ink, the ink-jet printer stops printing at a stage prior to complete consumption of the ink present in the downstream of the sensor unit 30 (for example, the buffer chamber 440) in the ink cartridge 1 and informs the user of the out-of-ink. This arrangement effectively prevents invasion of the air into the print head and decreases the remaining amount of ink in the ink cartridge 1 at the time of detection of the out-of-ink.

Figure 5:
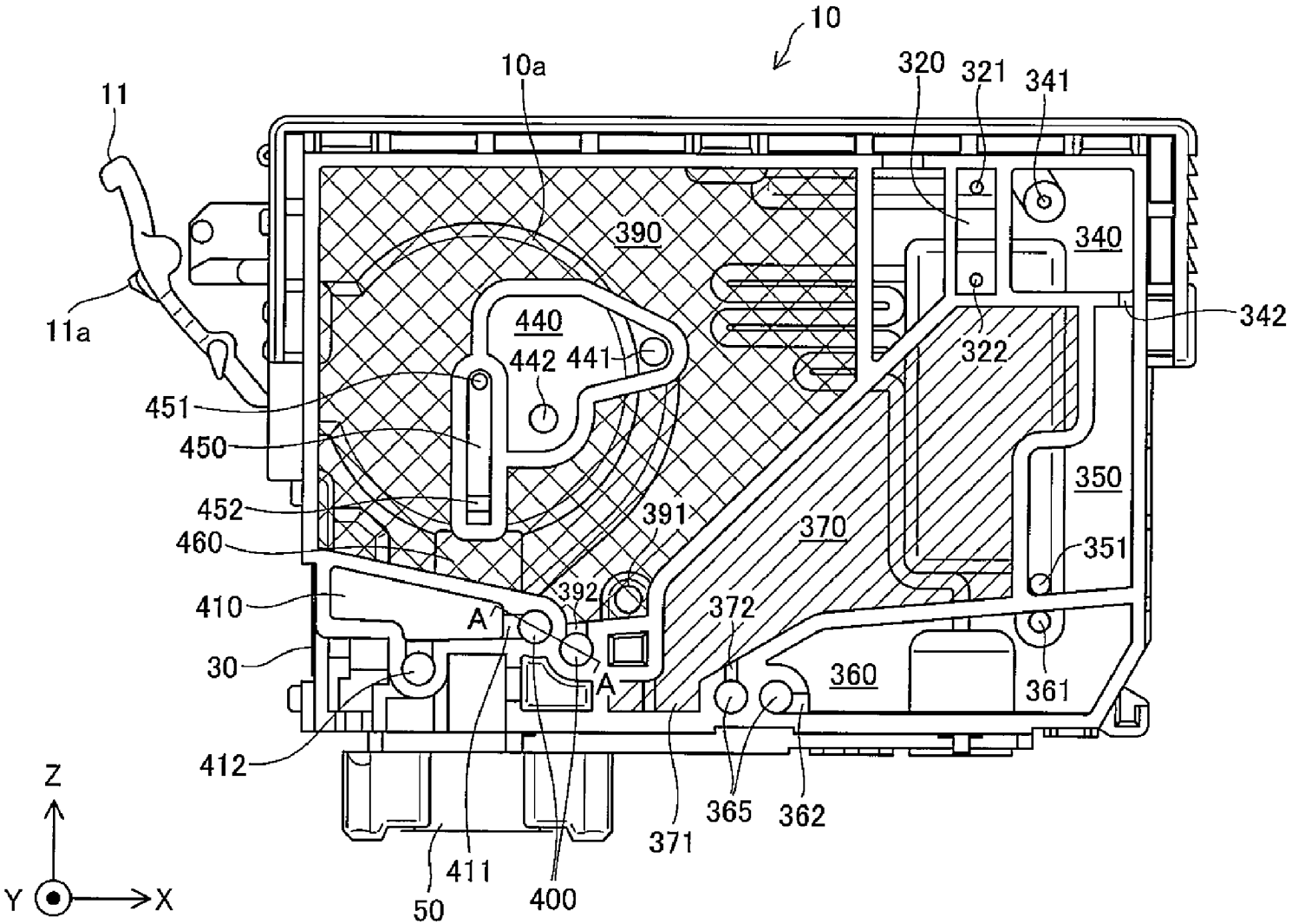
FIG. 5 is a front view showing the cartridge body in the ink cartridge of the first embodiment.
Figure 6:
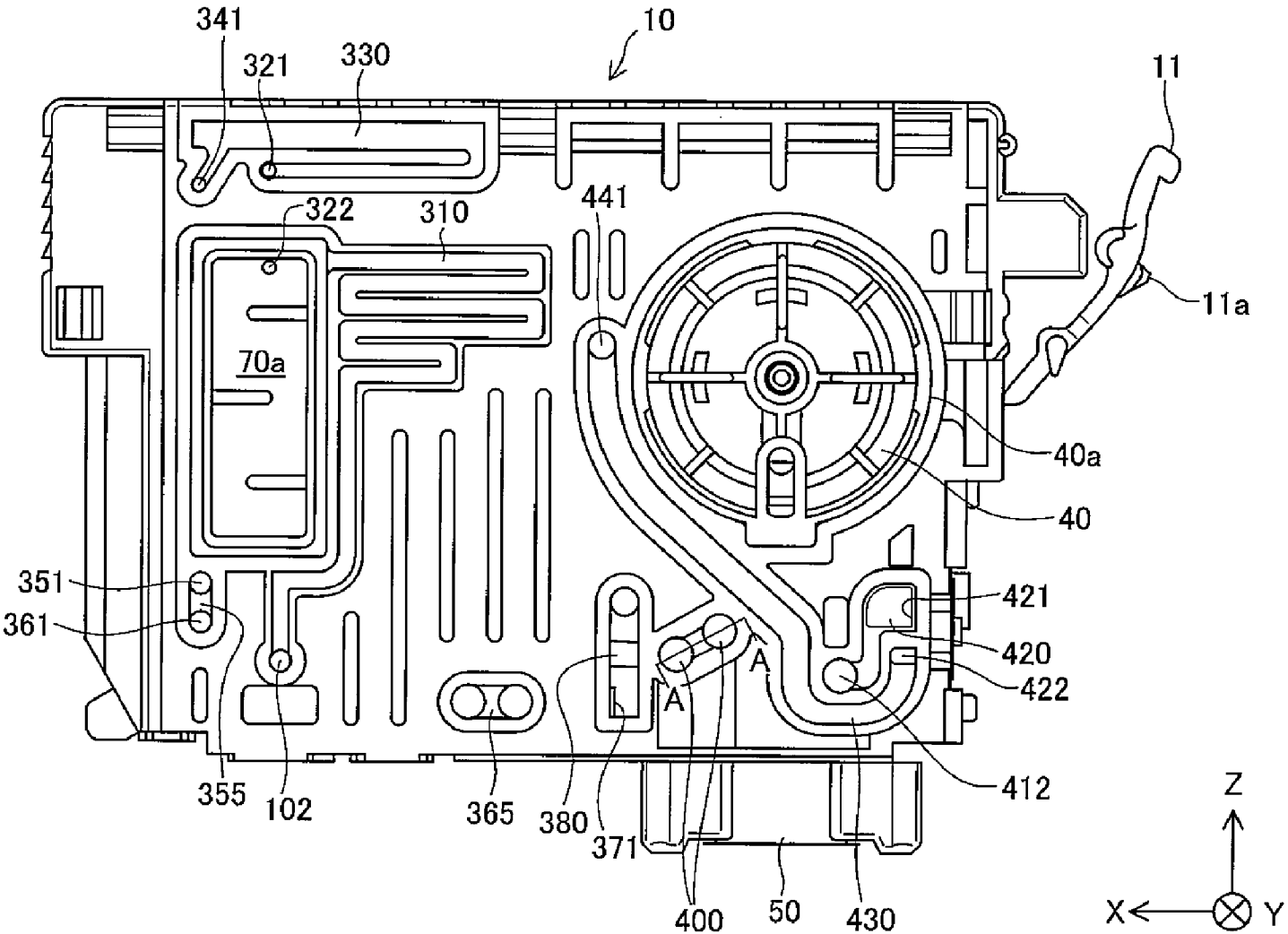
FIG. 6 is a rear view showing the cartridge body in the ink cartridge of the first embodiment.

On the basis of the above discussion, the concrete structures of the respective components of the ink cartridge 1 in the pathway from the air hole 100 to the liquid feeder 50 are described with reference to FIGS. 5 and 6. FIG. 5 is a front view showing the cartridge body 10 in the ink cartridge 1 of the first embodiment. FIG. 6 is a rear view showing the cartridge body 10 in the ink cartridge 1 of the first embodiment.

The first liquid reservoir 370 and the second liquid reservoir 390 of the ink reservoir assembly are provided on the front face of the cartridge body 10. The first liquid reservoir 370 and the second liquid reservoir 390 are shown as a single hatched area and a cross hatched area in FIG. 5. The communicating path 380 is formed in a center portion on the rear face of the cartridge body 10 as shown in FIG. 6. A communication hole 371 is formed to connect the upstream end of the communicating path 380 with the first liquid reservoir 370. A communication hole 391 is formed to connect the downstream end of the communicating path 380 with the second liquid reservoir 390.

The serpentine path 310 and the gas liquid separation chamber 70*a* of the air introduction assembly are formed in a specific area close to the right side on the rear face of the cartridge body 10 as shown in FIG. 6. A communication hole 102 is formed to connect the upstream end of the serpentine path 310 with the air hole 100. The downstream end of the serpentine path 310 passes through the side wall of the gas liquid separation chamber 70*a* to communicate with the gas liquid separation chamber 70*a*.

Among the air chambers 320 to 360 of the air introduction assembly shown in FIG. 4, the air chambers 320, 340, 350, and 360 are provided on the front face of the cartridge body 10 (see FIG. 5), whereas the air chamber 330 is provided on the rear face of the cartridge body 10 (see FIG. 6). The respective air chambers 320 to 360 are arranged in series in this sequence from the upstream to the downstream to form one flow path. A communication hole 322 is formed to connect the gas liquid separation chamber 70*a* with the air chamber 320. Communication holes 321 and 341 are respectively formed to connect the air chamber 320 with the air chamber 330 and to connect the air chamber 330 with the air chamber 340. The air chambers 340 and 350 are interconnected via a cutout 342 formed in a rib parting the air chamber 340 from the air chamber 350. A connection structure 355 formed to have a communication hole 351 at an upstream end and a communication hole 361 at a downstream end connects the air chamber 350 with the air chamber 360. A connection structure 365 formed to have a cutout 362 at an upstream end and a cutout 372 at a downstream end connects the air chamber 360 with the first liquid reservoir 370. The sterical arrangement of the mutually parted air chambers 320 to 360 effectively prevents the backflow of ink from the first liquid reservoir 370 to the gas liquid separation chamber 70*a*.

The bubble trap flow path 400 and the bubble trap chamber 410 of the ink fluid assembly are provided at a specific position close to the liquid feeder 50 on the front face of the cartridge body 10 as shown in FIG. 5. The second liquid reservoir 390 has a cutout 392 communicating with the upstream end of the bubble trap flow path 400. The downstream end of the bubble trap flow path 400 is formed to communicate with the bubble trap chamber 410 via a cutout 411.

Figure 7:
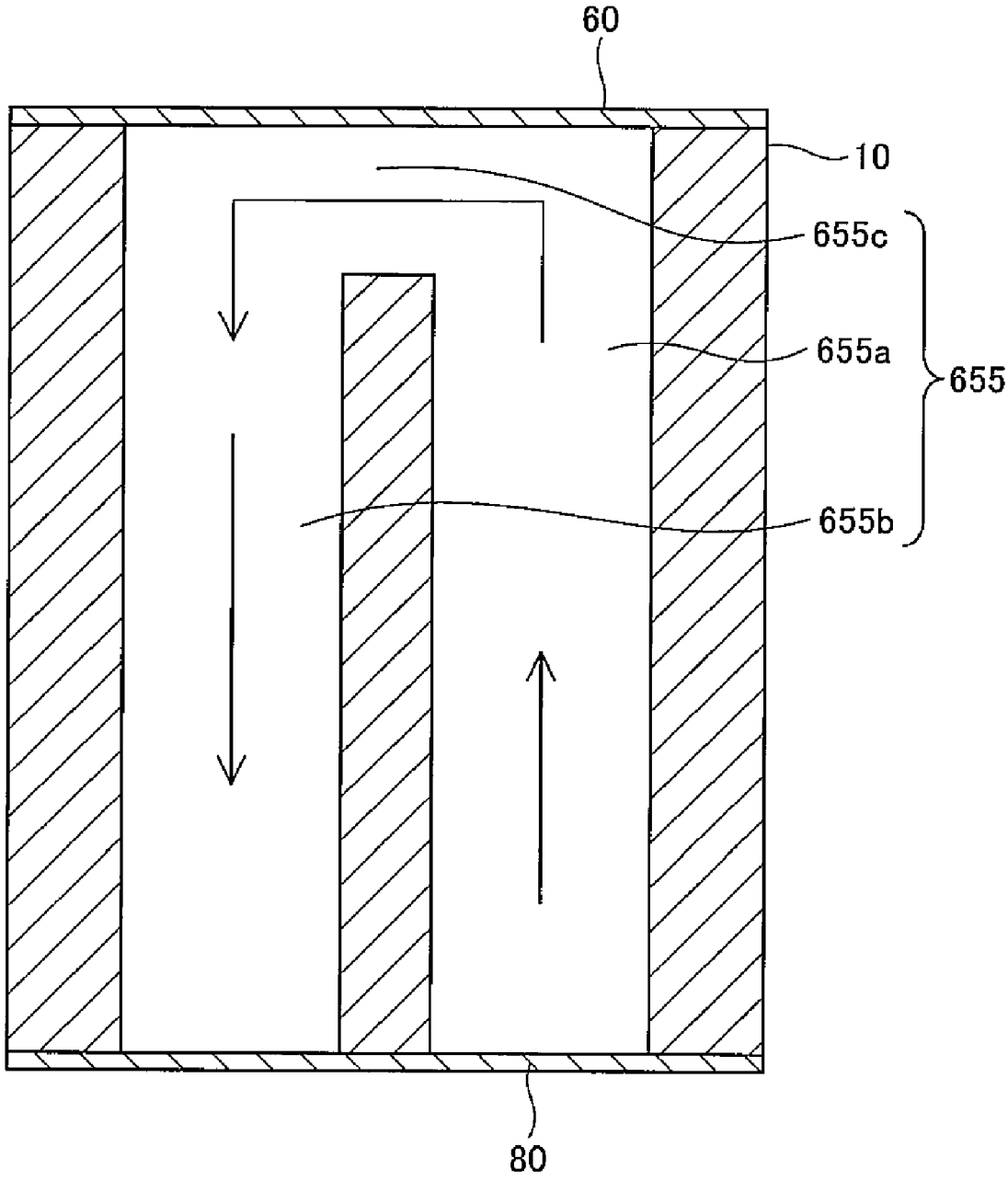
FIG. 7 is an explanatory view showing the structure of a bubble trap flow path.

FIG. 7 is an explanatory view showing the structure of the bubble trap flow path 400. FIG. 7 shows a cross section, taken on a line A-A in FIGS. 5 and 6. The bubble trap flow path 400 has a first through hole 655*a*, a second through hole 655*b*, and a turndown 655*c*. The first through hole 655*a* and the second through hole 655*b* are formed to pass through the cartridge body 10 from the front face to the rear face. A downstream end of the first through hole 655*a* is connected with an upstream end of the second through hole 655*b* via the turndown 655*c*. The first through hole 655*a* and the second through hole 655*b* are thus integrated to form one long bubble trap flow path 400. The openings at both ends of the first through hole 655*a* and the second through hole 655*b* are sealed with the outer surface film 60 and with the film 80. Namely the inner walls of the first through hole 655*a*, the second through hole 655*b*, and the turndown 655*c* in combination with the inner faces of the outer surface film 60 and the film 80 define the bubble trap flow path 400. The required shape for the bubble trap flow path 400 is readily obtained by simply forming the two through holes 655*a* and 655*b* and the turndown 655*c* that interconnects the corresponding ends of the through holes 655*a* and 655*b* in the cartridge body 10. This arrangement desirably facilitates production of the cartridge body 10. The relatively long flow path length of the bubble trap flow path 400 effectively prevents migration of bubbles from the second liquid reservoir 390 into the bubble trap chamber 410. The turndown shape of the bubble trap flow path 400 interconnecting the two through holes at the corresponding ends gives the sufficient flow path length to the bubble trap flow path 400 in a space-saving manner. This shape of the bubble trap flow path 400 desirably prevents migration of bubbles into the bubble trap chamber 410, which is caused by a change of external environment, for example, a variation of the ambient temperature or a variation of the outside atmospheric pressure. For example, in an ink-freezing environment at decreased ambient temperature, ink filled in the bubble trap chamber 410 increases its volume and flows into the second liquid reservoir 390. The ink decreases its volume to the original level when being unfrozen. The ink may be unfrozen in the state where the cutout 411 (inlet) of the bubble trap chamber 410 is in contact with the air in the second liquid reservoir 390 according to the attitude of the ink cartridge 1. In this state, the air in the second liquid reservoir 390 may flow into the bubble trap chamber 410 to form bubbles in the bubble trap chamber 410. In the structure of the embodiment, the bubble trap flow path 400 is designed to have a specific flow path length ensuring a greater volume than the increased volume of frozen ink filled in a space between the bubble trap chamber 410 and the buffer chamber 440. This arrangement effectively makes the unfrozen ink remain in the bubble trap flow path 400 and thereby controls or prevents migration of the air (bubbles) into the bubble trap chamber 410. The buffer chamber 440 is designed by taking into account the potential volume increase of ink. This design further contributes to preventing migration of bubbles in the downstream of the bubble trap chamber 410.

The sensor unit 30 is located in a lower area of the left lateral face of the cartridge body 10 as mentioned previously with reference to FIG. 2. The first fluid path 420 connecting the bubble trap chamber 410 with the sensor unit 30 and the second fluid path 430 connecting the sensor unit 30 with the buffer chamber 440 are formed on the rear face of the cartridge body 10 as shown in FIG. 6. The bubble trap chamber 410 has a communication hole 412 to connect the bubble trap chamber 410 to the first fluid path 420. A communication hole 421 is formed to connect the first fluid path 420 with the sensor unit 30. Communication holes 422 and 441 are respectively formed to connect the sensor unit 30 with the second fluid path 430 and to connect the second fluid path 430 with the buffer chamber 440.

Figure 8:
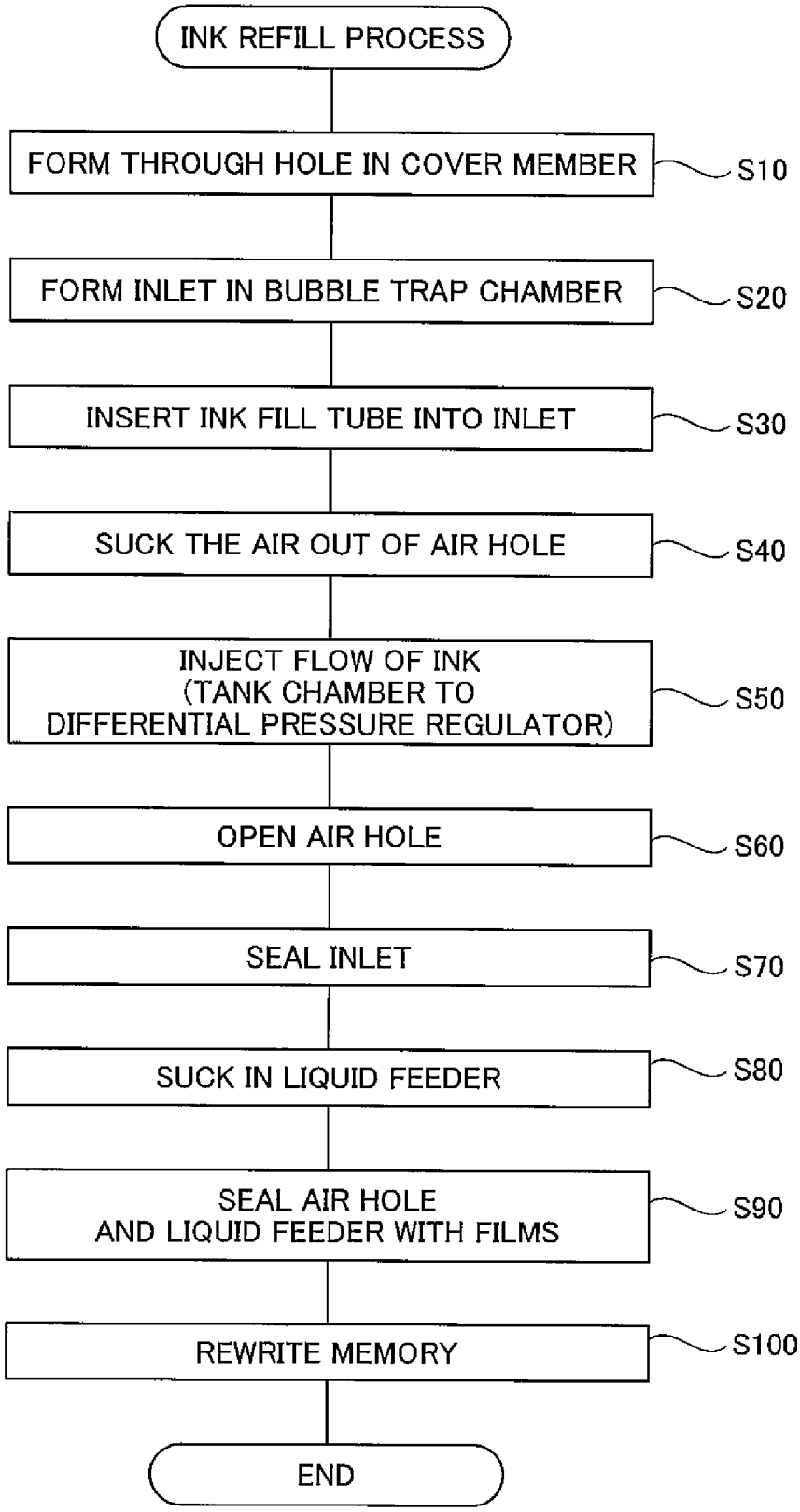
FIG. 8 is a flowchart showing a processing flow of ink refill process.

The buffer chamber 440 and the third fluid path 450 are formed in a specific area close to the left side on the front face of the cartridge body 10 as shown in FIG. 5. A communication hole 441 is formed to connect the downstream end of the second fluid path 430 with the buffer chamber 440. A communication hole 442 is formed to directly connect the buffer chamber 440 with the differential pressure regulator chamber 40*a*. A communication hole 451 is formed to connect the differential pressure regulator chamber 40*a* with the third fluid path 450. A communication hole 452 is formed to connect the third fluid path 450 with the fourth fluid path 460 provided inside the liquid feeder 50.

b. Ink Refill Method:

FIG. 8 is a flowchart showing a processing flow of ink refill process. The ink refill process refills ink into the ink cartridge 1 that is attached to the ink-jet printer and has an ink level of or below a specific value.

Figure 9:
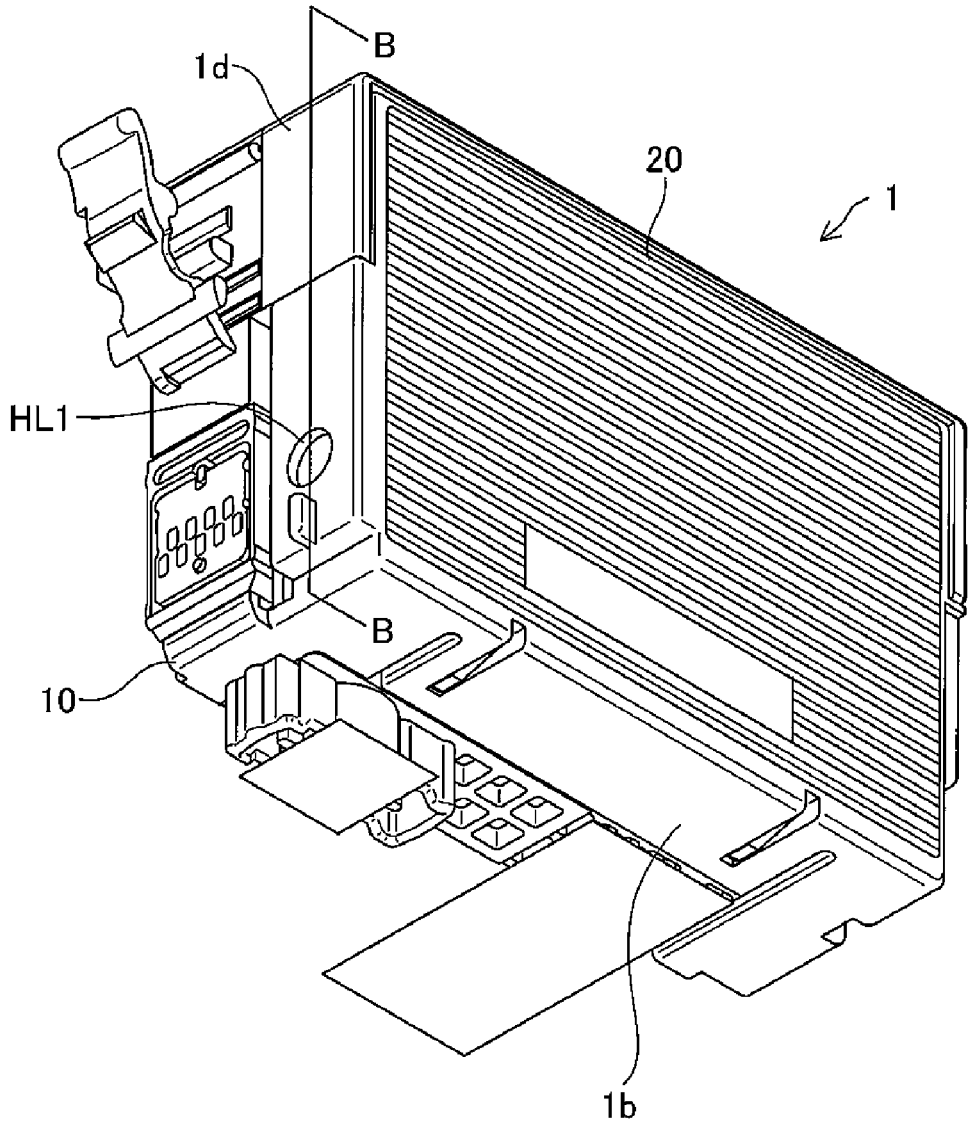
FIG. 9 is a perspective view showing a cover member with a through hole formed therein in the ink cartridge of the first embodiment.
Figure 9:
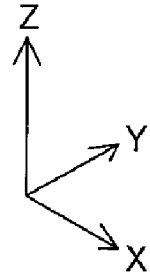

FIG. 9 is a perspective view showing the cover member 20 with a through hole HL1 formed therein in the ink cartridge 1 of the first embodiment. The processing flow first forms the through hole HL1 of preset dimensions at a specific position close to the bottom face 1*b* on the left lateral face 1*d* of the cover member 20 in the ink cartridge 1 (step S10).

Figure 10:
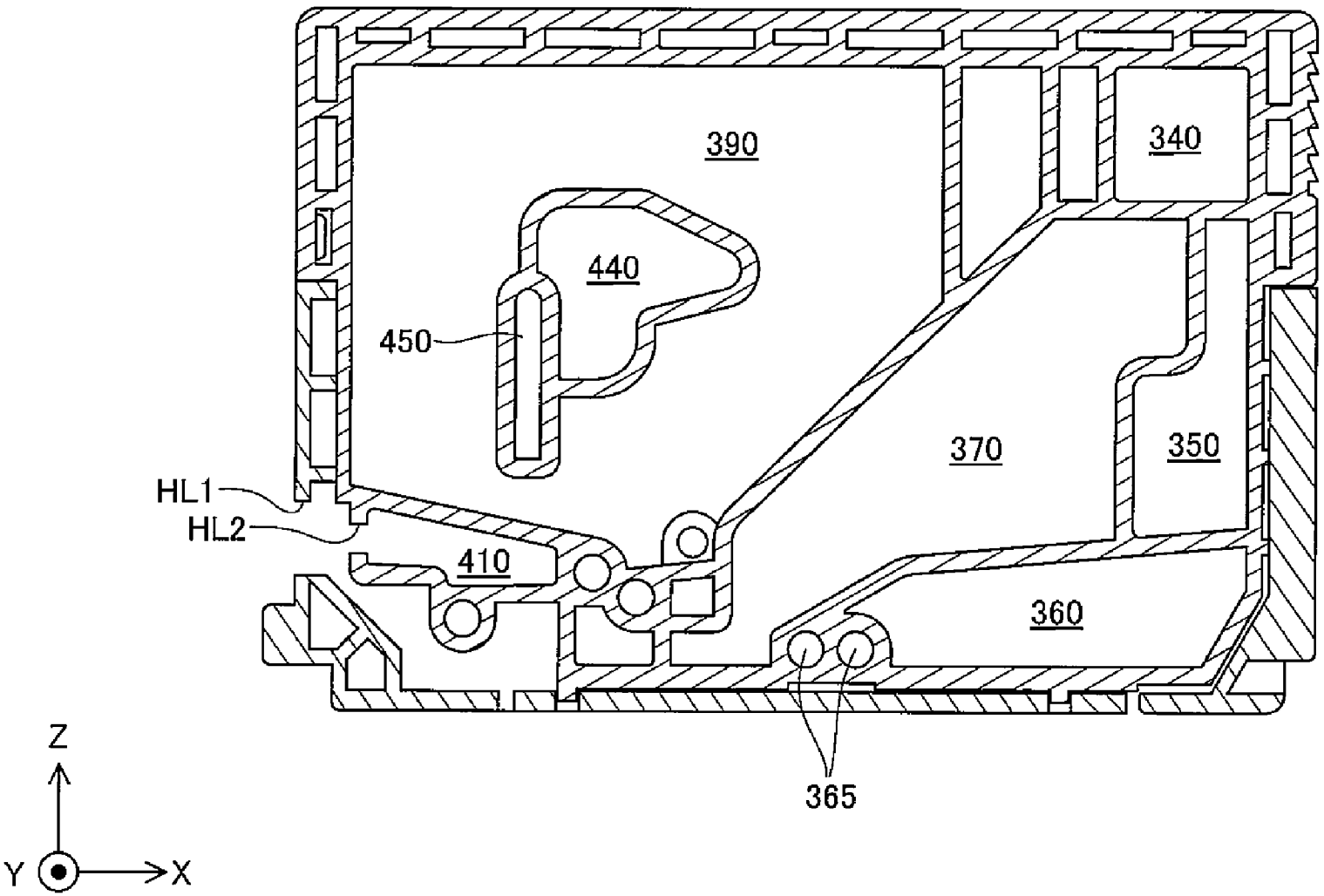
FIG. 10 is a sectional view of the ink cartridge, taken on a line B-B in FIG. 9.

FIG. 10 is a sectional view of the ink cartridge 1, taken on a line B-B in FIG. 9. The B-B cross section is parallel to a ZX plane and passes through the center of the through hole HL1. After formation of the through hole HL1, the processing flow forms an inlet HL2 on the wall surface of the bubble trap chamber 410 at the back of the through hole HL1 in the cartridge body 10 (step S20). The through hole HL1 and the inlet HL2 may be bored with a drill. The through hole HL1 is formed to have a larger diameter than the diameter of the inlet HL2. For example, the diameter of the inlet HL2 is about 3 mm, and the diameter of the through hole HL1 is about 6 mm.

Figure 11:
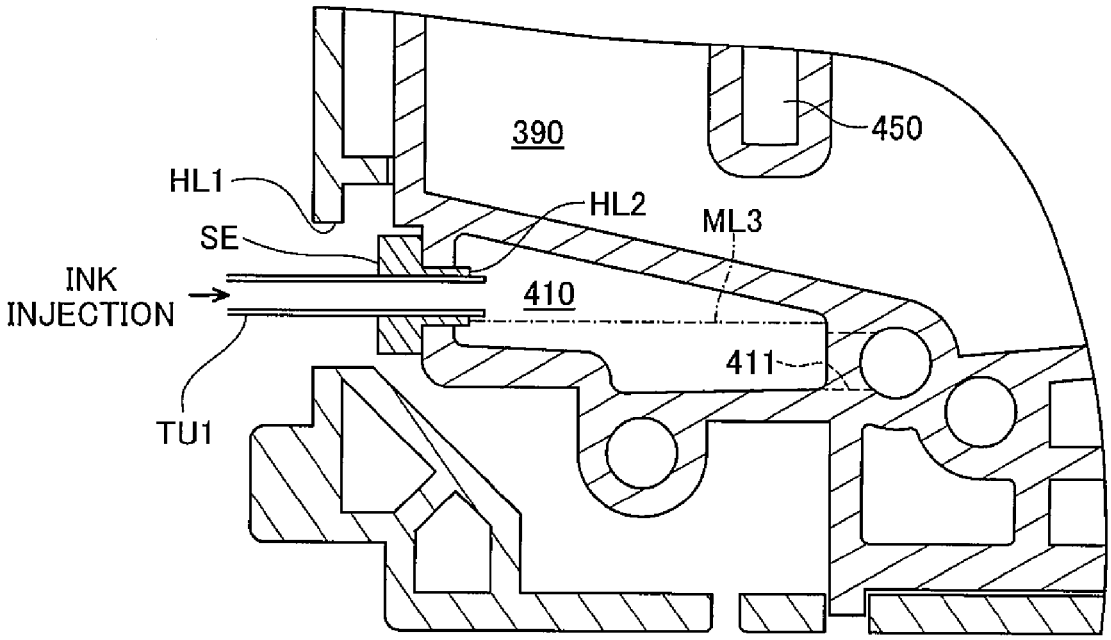
FIG. 11 is an enlarged sectional view showing the periphery of a bubble trap chamber in the ink cartridge of FIG. 10.

FIG. 11 is an enlarged sectional view showing the periphery of the bubble trap chamber 410 in the ink cartridge 1 of FIG. 10. After formation of the inlet HL2, the processing flow inserts an ink fill tube TU1 into the inlet HL2 (step S30). As shown in FIG. 10, a sealing member SE is attached to an insertion end of the ink fill tube TU1 to seal between an inner wall of the inlet HL2 and an outer wall of the ink fill tube TU1. A concrete procedure may set the seal member SE in advance on the insertion end of the ink fill tube TU1 and insert the seal member SE into the inlet HL2.

Figure 12:
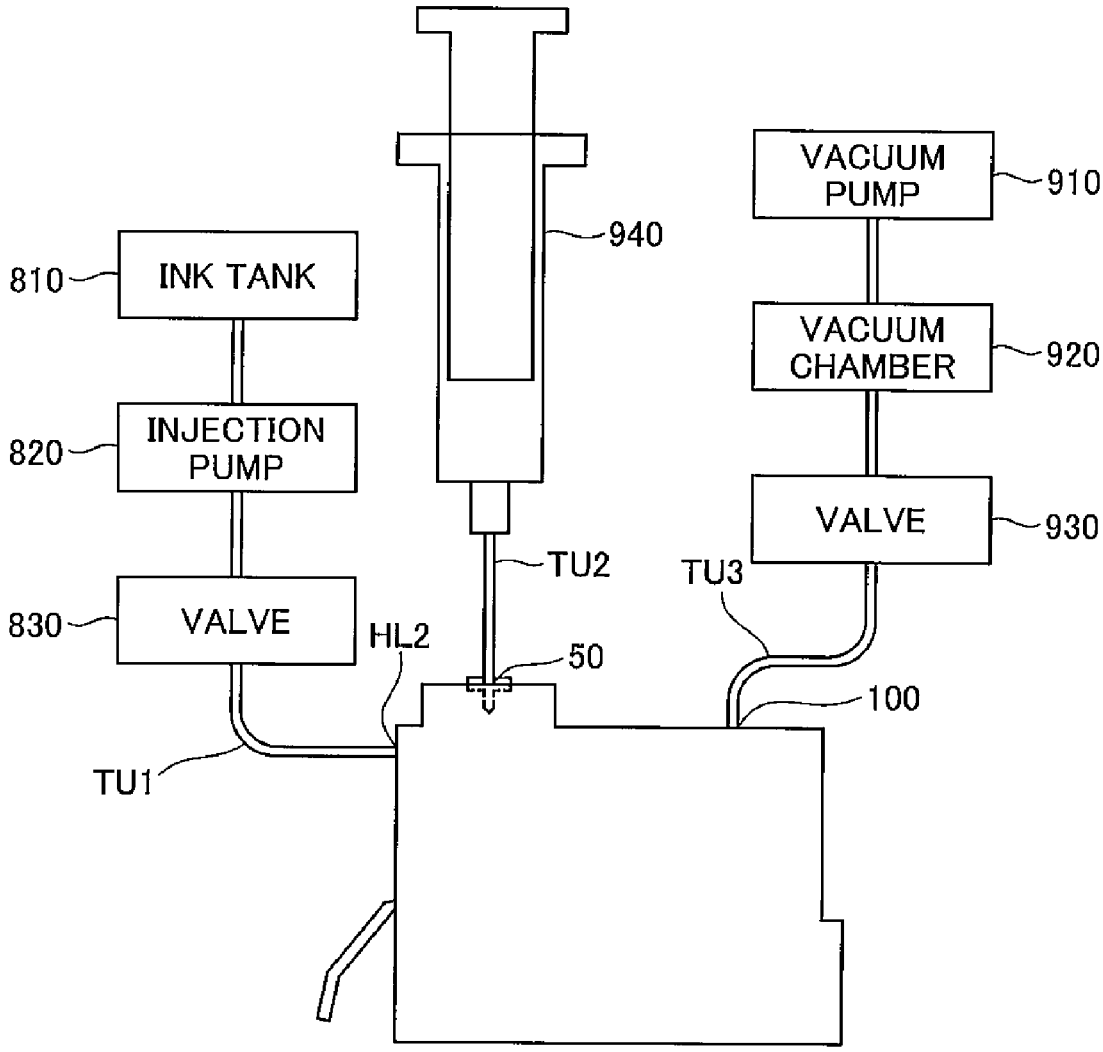
FIG. 12 is an explanatory view showing equipment used for ink refill into the ink cartridge.

FIG. 12 is an explanatory view showing equipment used for ink refill into the ink cartridge 1. A valve 830 is connected in the upstream of the ink fill tube TU1. An injection pump 820 and an ink tank 810 for ink storage are provided in the upstream of the valve 830. Opening the valve 830 and activating the injection pump 820 cause the ink stored in the ink tank 810 to be flowed through the ink fill tube TU1 and introduced into the ink cartridge 1. At the stage of insertion of the ink fill tube TU1, the valve 830 is closed.

After insertion of the ink fill tube TU1, the processing flow starts sucking the air out of the air hole 100 to reduce the internal pressure of the ink cartridge 1 (step S40). The air hole 100 is connected with a valve 930, a vacuum chamber 920, and a vacuum pump 910 via a suction tube TU3. The vacuum pump 910 is activated to sufficiently reduce the internal pressure of the vacuum chamber 920. The valve 930 is then opened to suck the air out of the air hole 100.

In the state of air suction through the air hole 100, the processing flow activates the injection pump 820 and opens the valve 830 to inject the flow of ink into the ink cartridge 1 (step S50). In the state of air suction out of the air hole 100, the differential pressure regulator 40 is set closed. The ink flow is accordingly not injected in the downstream of the differential pressure regulator 40. The ink is filled first into a downstream ink flow path to the differential pressure regulator 40 in the downstream of the bubble trap chamber 410 and then into an upstream ink flow path in the upstream of the bubble trap chamber 410. When the first liquid reservoir 370 is sufficiently filled with the ink, the valve 830 is closed to terminate the injection of the ink.

On completion of the ink refill, the processing flow closes the valve 930, stops the air suction through the air hole 100, and detaches the suction tube TU3 to opens the air hole 100 to the atmosphere (step S60).

Figure 13:
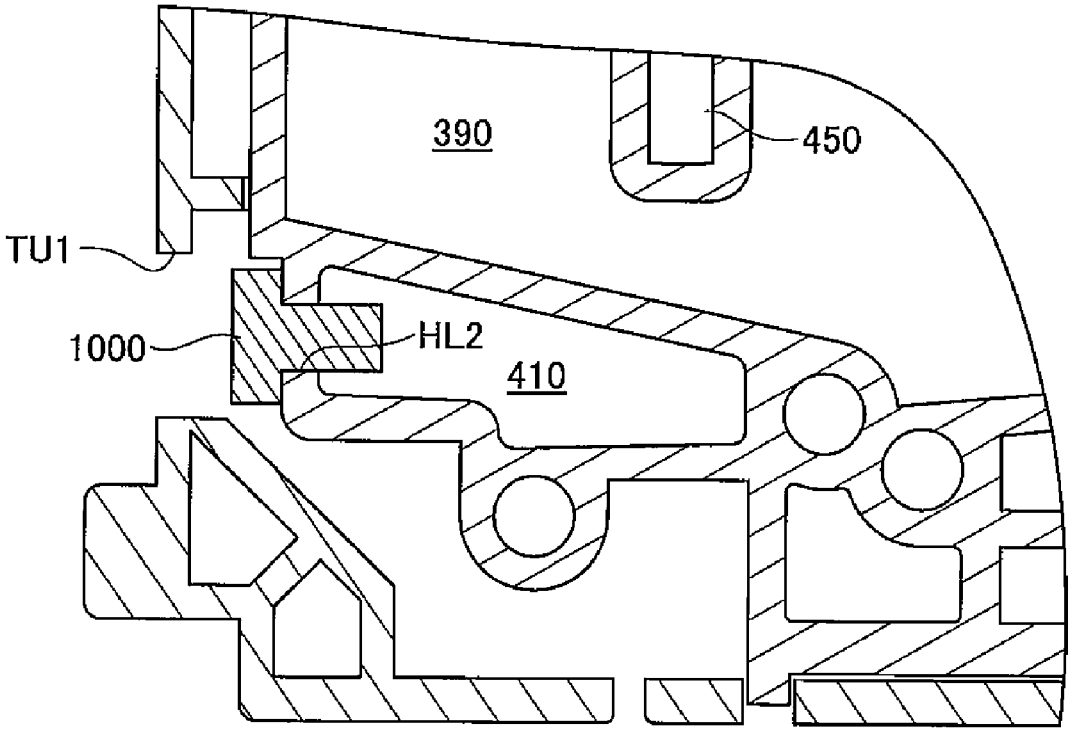
FIG. 13 is an explanatory view showing insertion of a sealing member into an inlet of the ink cartridge.

FIG. 13 is an explanatory view showing insertion of a sealing member into the inlet HL2 of the ink cartridge 1. After opening the air hole 100 to the atmosphere, the processing flow seals the inlet HL2 (step S70). The inlet HL2 is sealed, for example, by insertion of a sealing member 1000 as shown in FIG. 13. The sealing member 1000 is preferably made of an elastic material, such as a rubber or elastomer material. The sealing member 1000 of the elastic material securely seals the inlet HL2 and is readily detached to allow plurality of ink refills.

After sealing of the inlet HL2, the processing flow sucks in the liquid feeder 50 (step S80). A suction tube TU2 is connected to the liquid feeder 50 via a needle member AP located on its one end to press up the spring washer 52 and open the liquid feeder 50 as shown in FIG. 12. The other end of the suction tube TU2 is connected with a syringe-like aspirator 940. Aspiration by the aspirator 940 sucks in the liquid feeder 50. The suction of the liquid feeder 50 causes the ink flow path from the differential pressure regulator 40 to the liquid feeder 50 to be filled with ink. The ink is accordingly filled in the whole ink flow pathway from the first liquid reservoir 370 to the liquid feeder 50. On completion of the ink refill, the processing flow seals the air hole 100 and the liquid feeder 50 with the sealing films 90 and 54 (step S90).

The processing flow subsequently rewrites the information on the consumed amount of ink to an enabled value in the non-volatile memory provided in the circuit board 35 of the ink cartridge 1 (step S100). When the ink consumption decreases the remaining amount of ink in the ink cartridge 1 to or below a preset level, information on this decreased amount of ink may be stored in the non-volatile memory. In this case, the ink-jet printer may detect the little ink or the out-of-ink in the ink cartridge 1 and prohibit a normal printing operation. In order to avoid such inconvenience, the information on the consumed amount of ink stored in the non-volatile memory is rewritten to the enabled value that represents the sufficient amount of ink of or over a preset value.

In the structure of the ink cartridge 1 of the first embodiment discussed above, the ink injection from the bubble trap chamber 410 first fills the ink sufficiently in the downstream flow path in the downstream of the bubble trap chamber 410 to the differential pressure regulator 40 including the sensor unit 30 and then fills the ink in the upstream flow path in the upstream of the bubble trap chamber 410. This arrangement effectively removes bubbles from the sensor unit 30 and the bubble trap chamber 410 and thereby decreases the potential for false detection of the sensor that falsely detects the out-of-ink although the ink actually remains in the ink cartridge 1. The bubble trap chamber 410 is required to satisfy a specific ink level that activates the bubble trapping function. In the attachment of the ink cartridge 1 to the ink-jet printer as the liquid ejection device, the minimum liquid level in the bubble trap chamber 410 is preferably above the position of the cutout 411 (above a liquid level ML3 in FIG. 11). The higher ink filling rate in the bubble trap chamber 410 is desired for the sufficient bubble trapping function. It is preferable that the ink filling rate in the bubble trap chamber 410 is substantially equal to 100%.

The air suction through the air hole 100 ensures the quick injection of ink. Formation of the through hole HL2 at the position corresponding to the inlet HL2 of the cartridge body 10 facilitates the ink injection without removal of the cover member 20.

B. Modifications of First Embodiment

Figure 14:
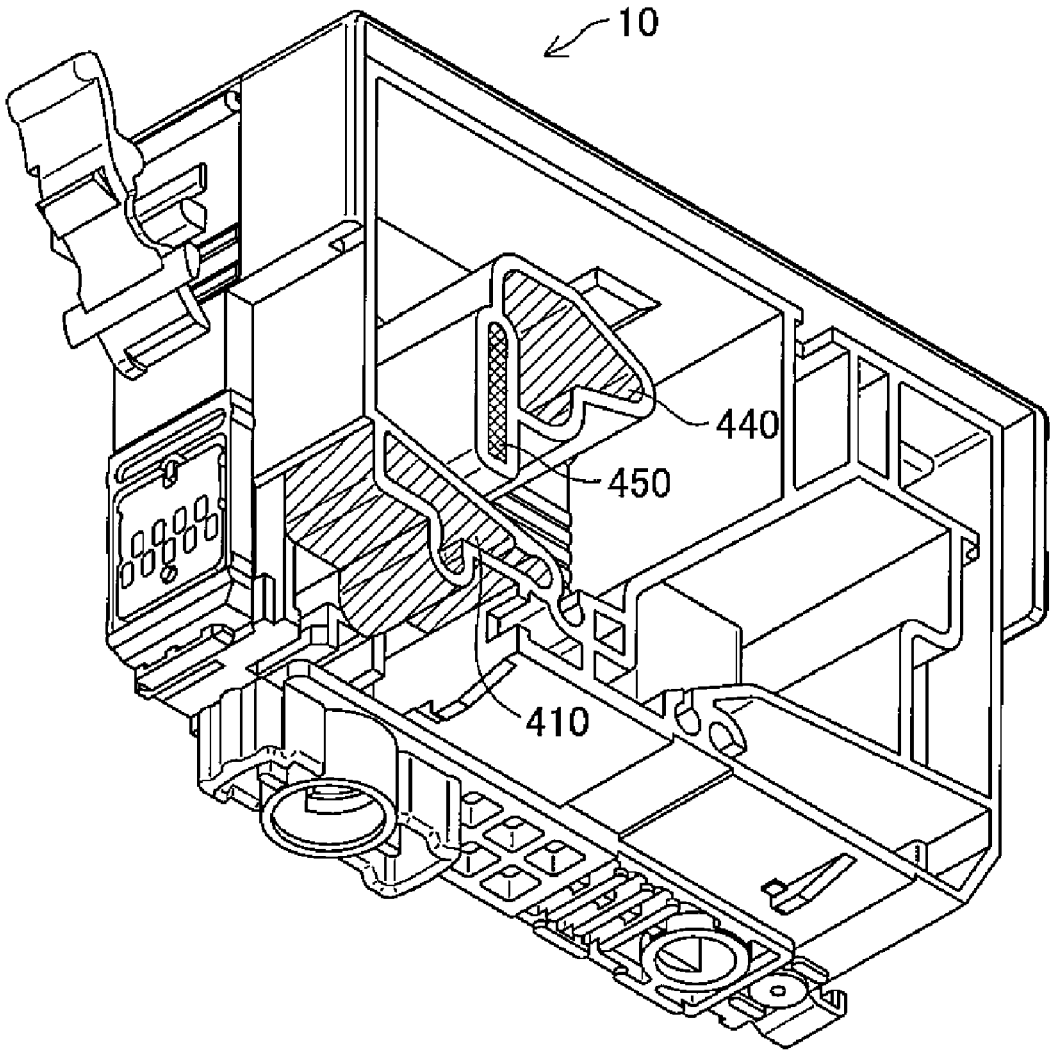
FIG. 14 is an explanatory view showing a modified structure of the cartridge body in one modified example of the first embodiment.

FIG. 14 is an explanatory view showing a modified structure of the cartridge body 10 in one modified example of the first embodiment. The position of the inlet HL2 is not restricted to the location in the first embodiment described above. In the case of ink injection from the bubble trap chamber 410, an inlet may be formed at any location in the wall surfaces of the left lateral face 1*d* and the bottom face 1*b* defining the bubble trap chamber 410 as shown by one hatched area in FIG. 14. An inlet may alternatively be formed in a specific area of the film 80 that covers over the front side of the bubble trap chamber 410. The ink may be injected from the buffer chamber 440, instead of the bubble trap chamber 410. In this case, an inlet may be formed in a specific area of the film 80 covering over the front side of the buffer chamber 440 as shown by another hatched area in FIG. 14.

Figure 15:
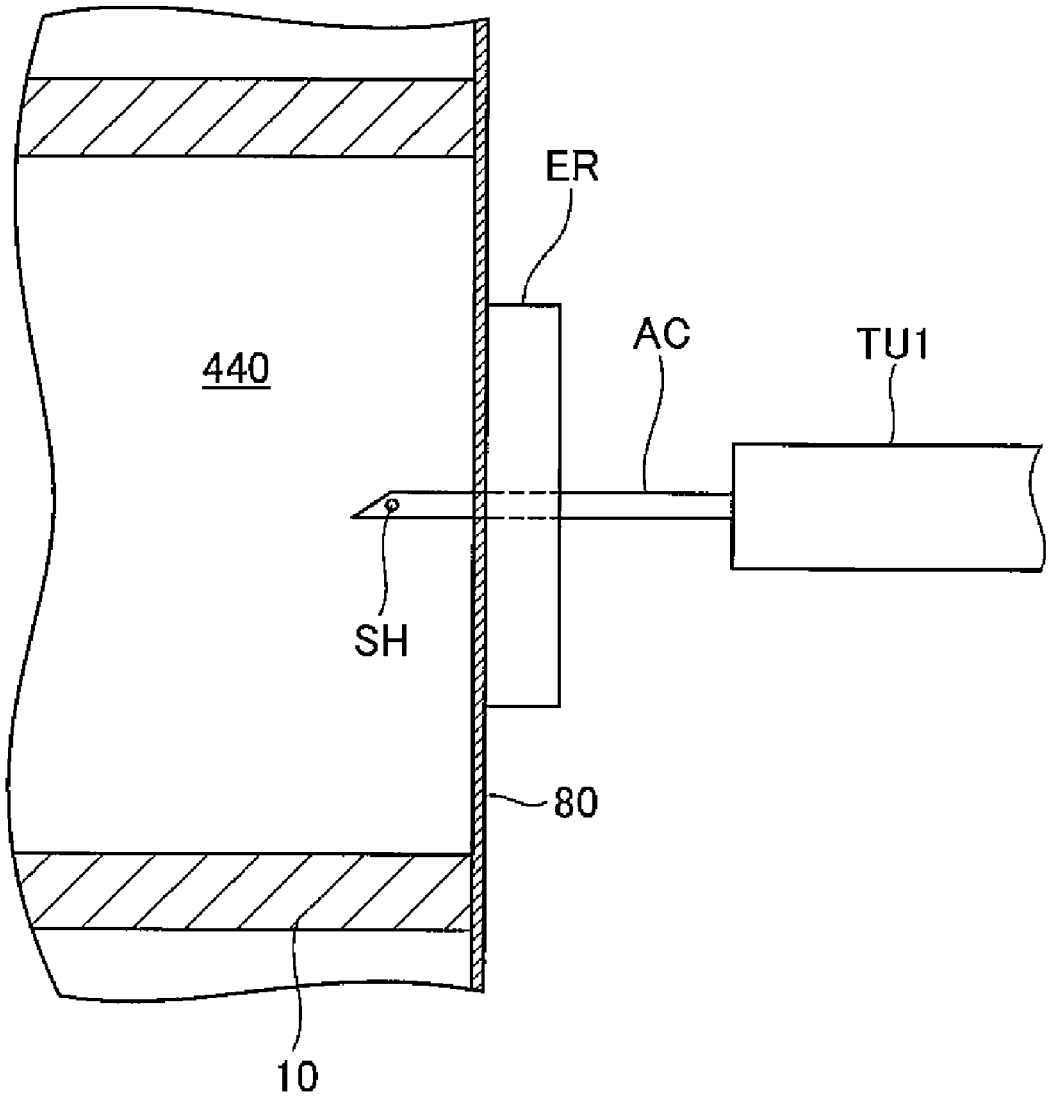
FIG. 15 is an explanatory view showing an inlet formed in a film in another modified example of the first embodiment.

FIG. 15 is an explanatory view showing an example of an inlet formed in the film 80 in another modified example of the first embodiment. In this illustrated example, an inlet is formed in a specific area of the film 80 that covers over the front side of the buffer chamber 440. The procedure first applies an elastic plate ER made of a rubber or elastomer material onto the specific area of the film 80 by an adhesive, and inserts a needle body AC attached to one end of the ink fill tube TU1 through the laminate of the elastic plate ER and the film 80. The needle body AC has a hollow structure with an end hole SH on its end. The flow of ink supplied via the ink fill tube TU1 is introduced through the needle body AC into the buffer chamber 440. This arrangement ensures introduction of ink into the ink cartridge 1 without causing ink leakage, while effectively preventing an unnecessary damage of the film 80. On completion of the ink refill, a hole formed by the needle body AC may be sealed with a film.

Figure 16:
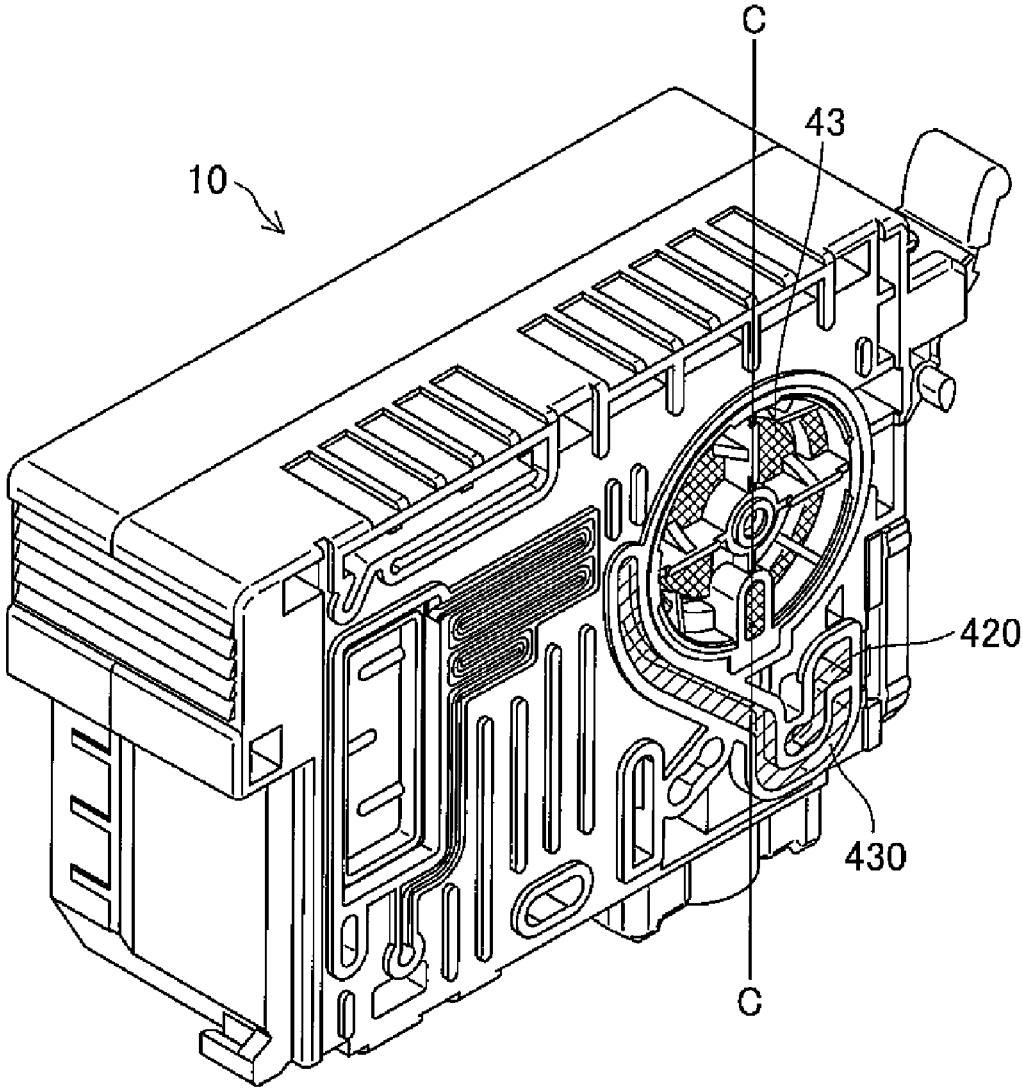
FIG. 16 is an explanatory view showing another modified structure of the cartridge body in still another modified example of the first embodiment.

FIG. 16 is an explanatory view showing another modified structure of the cartridge body 10 in still another modified example of the first embodiment. An inlet may be formed in a specific area of the outer surface film 60 that covers over the rear side of the second fluid path 430 and the first fluid path 420 as shown by hatched areas in FIG. 16.

Figure 17:
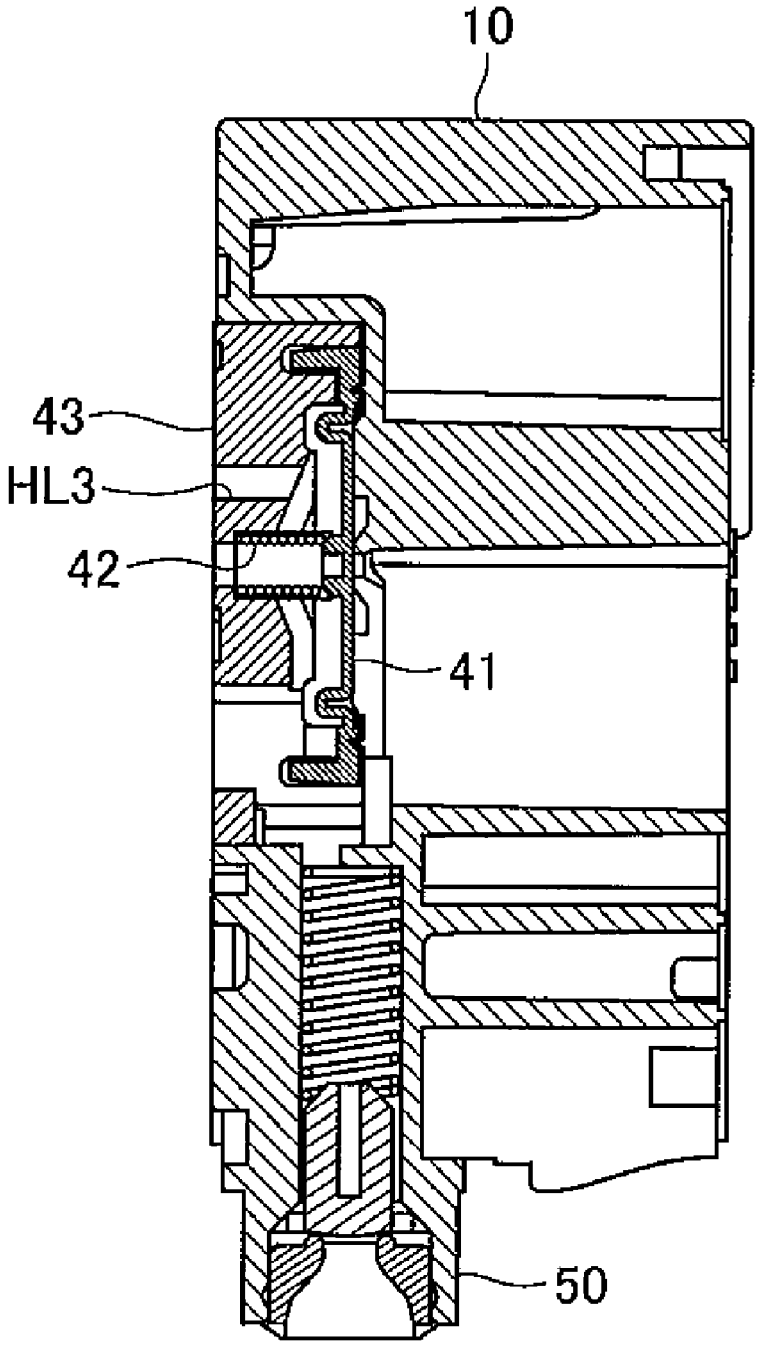
FIG. 17 is a sectional view, taken on a line C-C in FIG. 16.

A hole may be formed in the valve member 41 of the differential pressure regulator 40 to lose the function of the differential pressure regulator 40. In this case, an inlet may be provided in the third fluid path 450 in the downstream of the differential pressure regulator 40 or in the spring washer 43 of the differential pressure regulator 40 as shown by a cross hatched area in FIG. 16. In the illustrated example, the inlet is formed in the spring washer 43 of the differential pressure regulator 40. FIG. 17 is a sectional view, taken on a line C-C in FIG. 16. A hole HL3 passing through the spring washer 43 of the differential pressure regulator 40 is formed as an ink inlet in this illustrated example. As clearly understood from the above discussion, the inlet may be formed at any position in the bubble trap chamber 410 or at any position in the downstream flow path in the downstream of the bubble trap chamber 410.

C. Second Embodiment

The ink refill process of the first embodiment is not restrictively applied to the ink cartridge 1 of the first embodiment but is applicable to other various types of ink cartridges. One example of such various types of ink cartridges is discussed below as a second embodiment of the invention.

Figure 18:
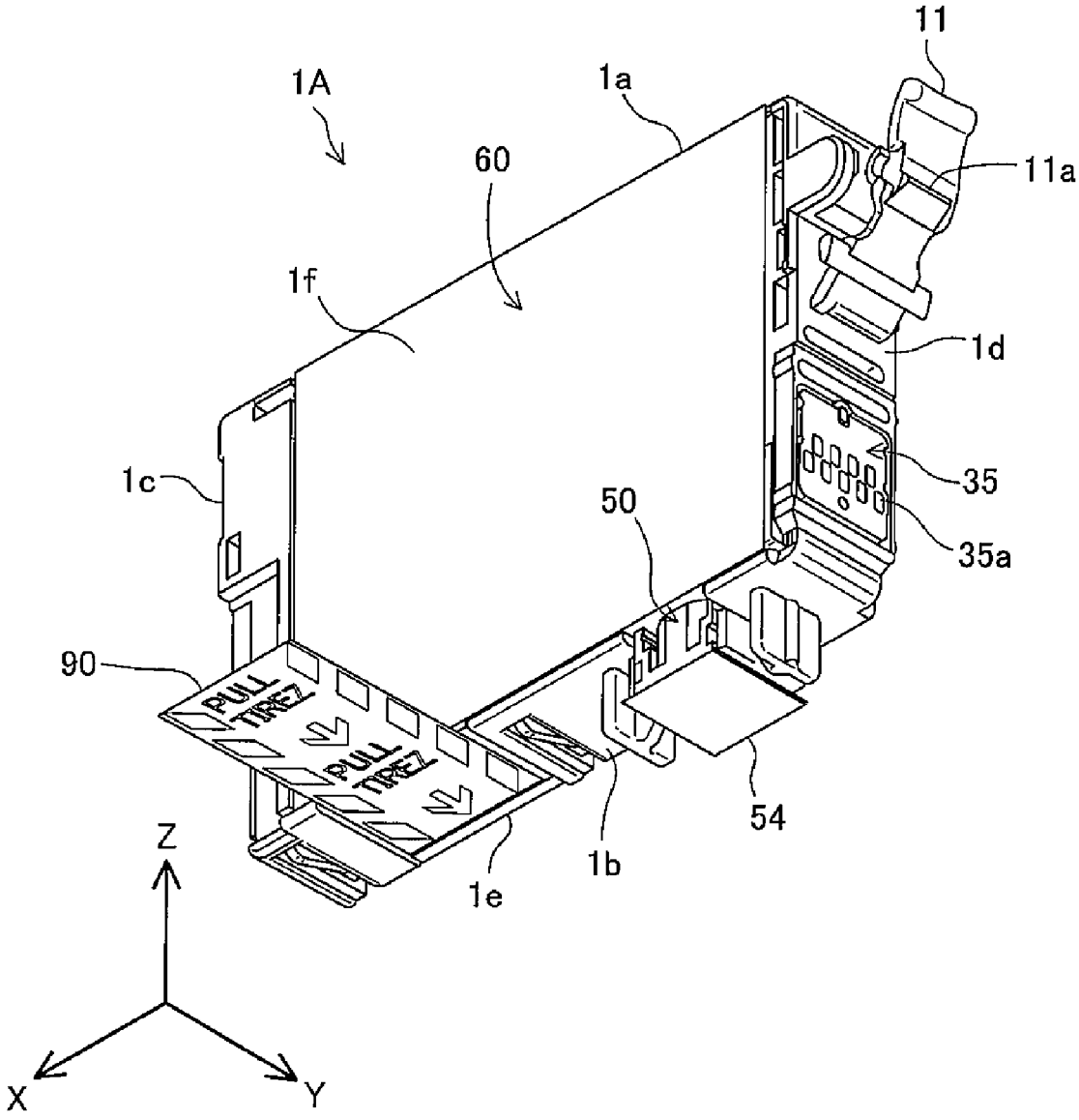
FIG. 18 is a perspective view showing the appearance of another ink cartridge in a second embodiment of the invention.
Figure 19:
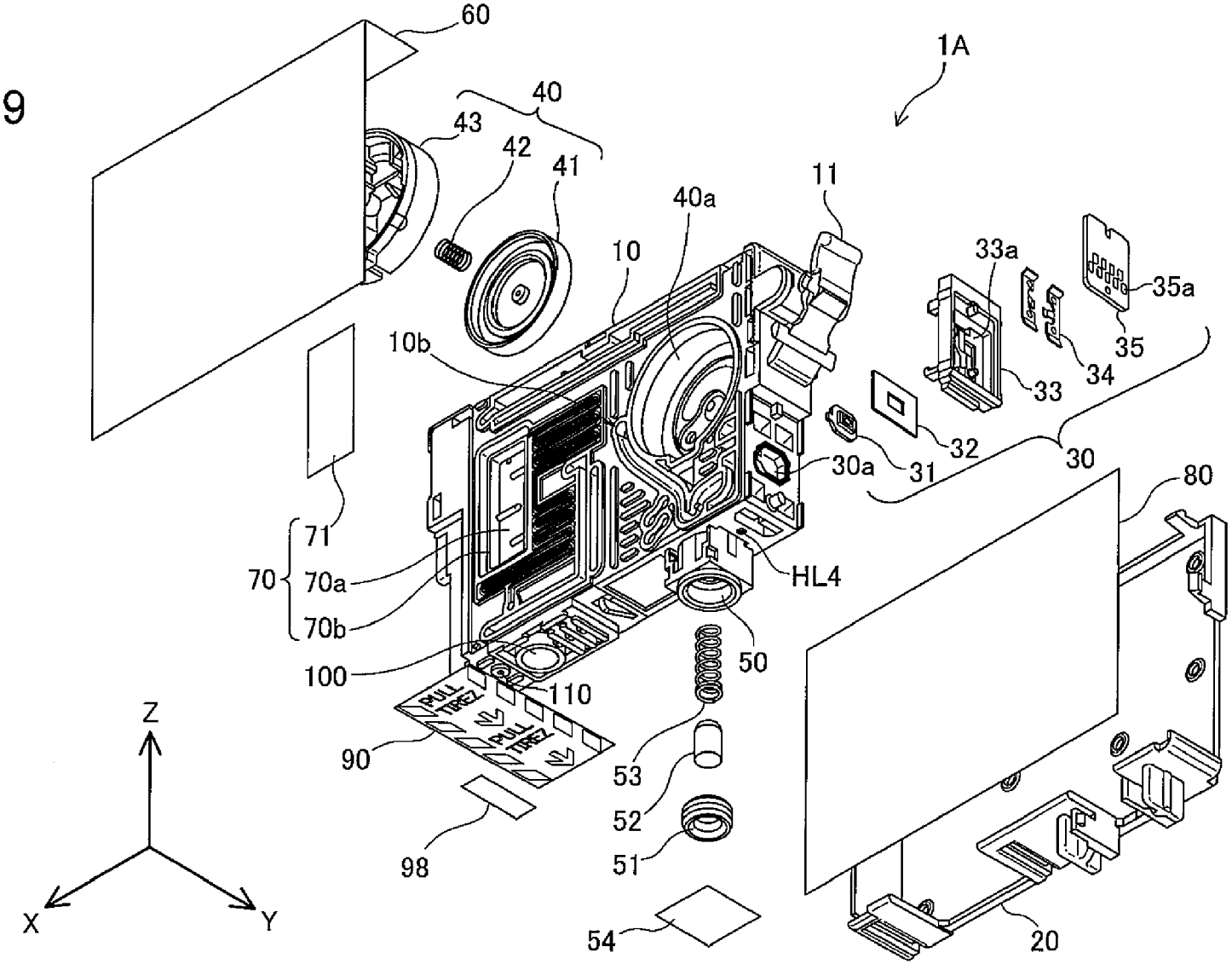
FIG. 19 is an exploded perspective view of the ink cartridge of the second embodiment shown in FIG. 18.
Figure 20:
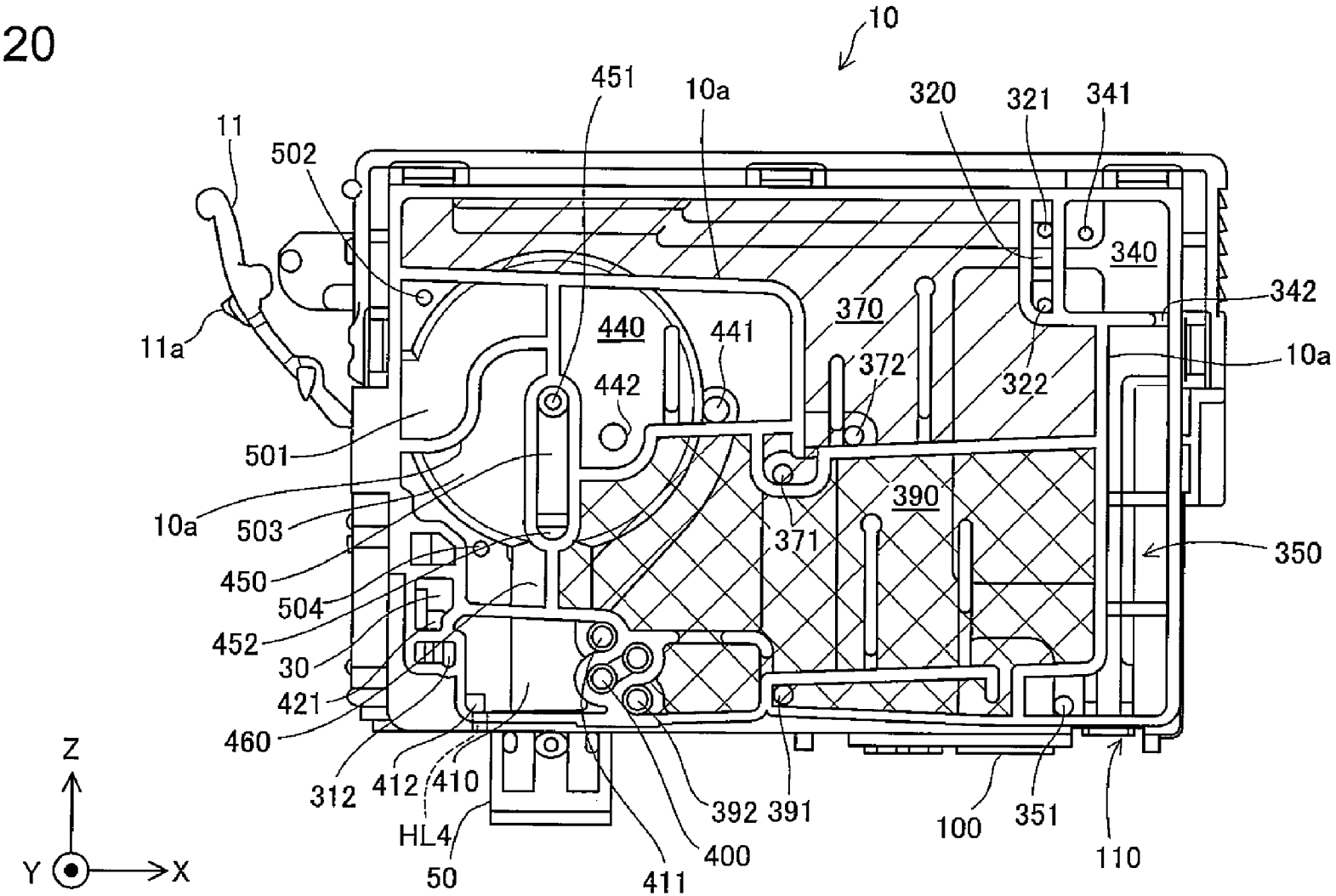
FIG. 20 is a front view showing a cartridge body in the ink cartridge of the second embodiment.
Figure 21:
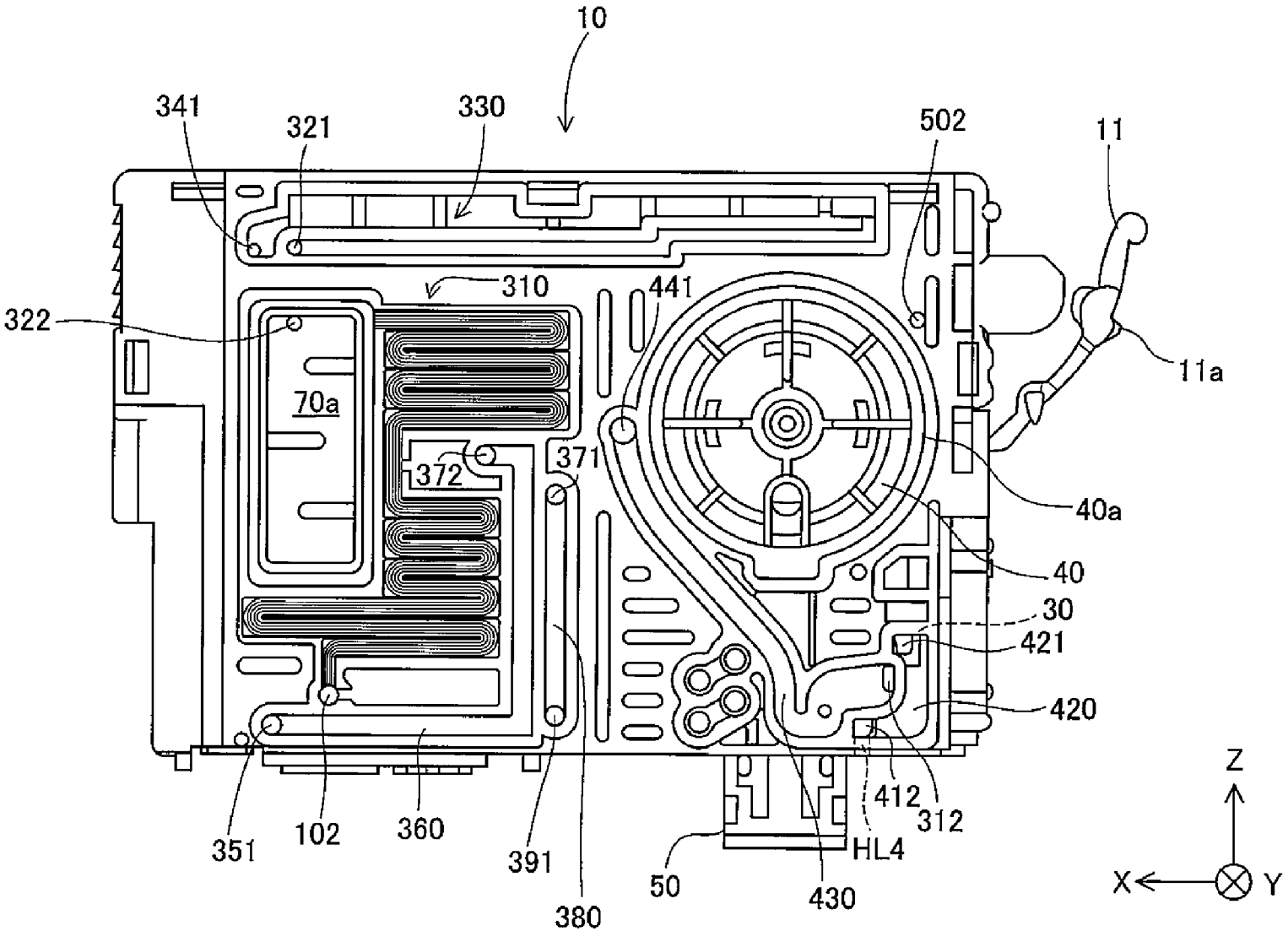
FIG. 21 is a rear view showing the cartridge body in the ink cartridge of the second embodiment.

FIG. 18 is a perspective view showing the appearance of another ink cartridge 1A in the second embodiment of the invention. FIG. 19 is an exploded perspective view of the ink cartridge 1A of the second embodiment shown in FIG. 18. FIG. 20 is a front view showing a cartridge body 10 in the ink cartridge 1A of the second embodiment. FIG. 21 is a rear view showing the cartridge body 10 in the ink cartridge 1A of the second embodiment.

The ink cartridge 1A of the second embodiment is a small-sized ink cartridge having substantially half the width of the ink cartridge 1 of the first embodiment in the Y-axis direction. The structures of the respective components and the ink flow pathway in the ink cartridge 1A of the second embodiment are similar to those in the ink cartridge 1 of the first embodiment. In FIGS. 18 through 21, the like elements and components in the ink cartridge 1A of the second embodiment to those in the ink cartridge 1 of the first embodiment shown in FIGS. 1 through 6 are expressed by the like numerals and symbols and are not specifically explained here.

As shown in FIG. 20, the ink cartridge 1A of the second embodiment has spaces 501 and 503, which are not included in the ink cartridge 1 of the first embodiment. The spaces 501 and 503 are non-fill chambers that are not filled with ink. The non-fill chambers 501 and 503 are separated from the pathway from the air hole 100 to the liquid feeder 50. An air communication hole 502 is formed on the rear side of the non-fill chamber 501 to communicate with the outside air. Similarly an air communication hole 504 is formed on the rear side of the non-fill chamber 503 to communicate with the outside air. The non-fill chambers 501 and 503 work as deaeration chambers with accumulation of negative pressure during packaging of the ink cartridge 1 under reduced pressure. In the packaged ink cartridge 1, the internal pressure of the cartridge body 10 is kept at or below a specified low pressure level. This structure ensures supply of ink containing little amount of dissolved air.

The structure of the bubble trap flow path 400 in the ink cartridge 1A of the second embodiment is slightly different from the structure of the bubble trap flow path 400 in the ink cartridge 1 of the first embodiment. In the ink cartridge 1A of the second embodiment, the bubble trap flow path 400 has four through holes. The ends of the four through holes are interconnected by means of cutouts on the front side or on the rear side to form one long flow path. The ink cartridge 1A of the second embodiment has the shorter width in the Y-axis direction. Each through hole in the bubble trap flow path 400 of the second embodiment accordingly has the shorter length than that of the through hole in the bubble trap flow path 400 of the first embodiment. The turndown shape of the fourth through holes gives the sufficient total flow path length required for the bubble trap flow path 400. In the attitude of the ink cartridge 1A with its bottom face 1*b* facing down, the four through holes are formed to intersect with the vertical direction (Z-axis direction) from the bottom face 1*b* and are arranged in zigzag in the vertical direction seen from the Y-axis direction. The four through holes and the cutouts interconnecting the respective ends of the four through holes are arranged to have multiple turndowns like dog-leg stairs. The four through holes are extended in the thickness direction (Y-axis direction) in parallel with the bottom face 1*b* of the ink cartridge 1A and are arranged at different heights in the vertical direction (height direction, Z-axis direction). The heights of the four through holes in the vertical direction sequentially increase from the upstream to the downstream. The bubble trap flow path 400 of the second embodiment having this turndown shape desirably prevents migration of bubbles into the bubble trap chamber 410, which is caused by a change of external environment, for example, a variation of the ambient temperature or a variation of the outside atmospheric pressure, like the shape of the bubble trap flow path 400 of the first embodiment explained previously.

In the structure of the second embodiment, an inlet HL2 for ink is formed, for example, in the wall surface of the bottom face 1*b* defining the bubble trap chamber 410 to communicate with the bubble trap chamber 410. As discussed previously in the modified structures of the first embodiment, an inlet may be formed in a specific area of the film 80 covering over the buffer chamber 440, in a specific area of the film 80 covering over the third fluid path 450, in a specific area of the outer surface film 60 covering over the second fluid path 430, or in a specific area of the outer surface film 60 covering over the first fluid path 420 in the ink cartridge 1A of the second embodiment. The respective steps of the ink refill process are identical with those of the first embodiment explained above with reference to the flowchart of FIG. 8 and are thus not specifically described here.

The ink refill process discussed in the first embodiment is applicable to the ink cartridge 1A of the second embodiment. The ink cartridge 1A of the second embodiment accordingly has the similar functions and effects to those of the ink cartridge 1 of the first embodiment discussed previously.

D. Other Aspects

Modification 1:

The ink refill process of the above embodiments discussed above injects the supply of ink, while sucking the air through the air hole 100. One modified procedure of the ink refill process may inject the supply of ink, while sucking the air through the decompression hole 110 or through the liquid feeder 50. The air suction may be continued during the ink injection, or alternatively the ink may be injected after stop of the air suction. The ink may be injected in the state open to the atmosphere without air suction through the air hole 100 or air suction through the decompression hole 110.

Modification 2:

It is not essential to seal the inlet during the ink injection. The sealing of the inlet is preferable to increase the efficiency of ink injection and prevent leakage of ink from the cartridge body 10.

Modification 3:

The ink is injected to the level of sufficiently filling the first liquid reservoir 370. The amount of ink injection may be changed according to the requirements. In application of a transparent film for the film 80, the amount of ink injection may be checked visually. In automated ink injection or in application of an opaque film for the film 80, a predetermined amount of ink may be injected.

Modification 4:

The technique of ink injection with the liquid pump 820 and the technique of suction out of the liquid feeder 50 with the aspirator 940 are not restrictive but are only illustrative. Any of other various techniques may be adopted for ink injection, for example, injection of ink with a syringe.

Modification 5:

In the structure of the ink cartridge 1 of the first embodiment, the inlet HL2 is formed after the through hole HL1 is opened in the cover member 20. One modified structure may detach the cover member 20 without opening the through hole HL1 and form the inlet HL2. Reattachment of the cover member 20 visually hides the hole for the inlet HL2. This improves the appearance.

Modification 6:

In the structure of the ink cartridge 1 of the first embodiment, the inlet HL2 is sealed with the elastic sealing member 1000 on completion of the ink refill. The inlet HL2 may be sealed by film welding or by bonding a non-elastic resin with an adhesive. The inlet HL2 and its periphery may be bonded with an adhesive. Any technique may be applied to seal the inlet HL2 in an air-tight manner.

Modification 7:

The ink cartridge 1 of the first embodiment has the non-volatile memory to store the information on the level of ink remaining in the ink cartridge 1. The ink refill process omits the memory rewriting step for the ink cartridge without a non-volatile memory. Another modification may replace a memory, instead of the memory rewriting. The concrete procedure replaces an old memory with a new memory storing an enabled value that represents the sufficient amount of ink of or over a preset value as the information on the ink level.

Modification 8:

The above embodiments and their modified examples describe the ink-jet printer and the ink cartridge as typical examples of the liquid ejection device and the liquid container. These are, however, neither essential nor restrictive. The liquid ejection device may be designed to inject, eject, or spray a liquid other than ink, and the liquid container may be designed to store the liquid other than ink. The technique of the invention is applicable to various liquid consuming devices equipped with a liquid ejection head for ejecting a trace amount of liquid droplets. The liquid droplet represents the state of the liquid ejected from the liquid ejection device and includes various shapes of droplets, for example, a granular shape, a tear drop shape, and a trailed threadlike shape. The terminology 'liquid' herein represents any material in a liquid phase that is ejectable by the liquid ejection device; for example, a liquid state having high viscosity or low viscosity or a fluid state like a sol, gel water, an inorganic solvent, an organic solvent, a solution, a liquid resin, or a liquid metal (molten metal). The 'liquid' herein is not restricted to the liquid state as one state of matter but may be a solution, a dispersion, or a mixture of particles of a functional solid material, such as pigment particles or metal particles. Typical examples of the 'liquid' are ink discussed in the above embodiments and liquid crystal. The terminology 'ink' herein represents any of various liquid compositions including conventional aqueous inks and oil inks, gel inks, hot melt inks. Typical examples of the liquid ejection device include a liquid ejection device designed for ejection of a dispersion or a solution of a material like an electrode material or a coloring material to manufacture liquid crystal displays, EL (electroluminescence) displays, surface-emitting displays, and color filters, a liquid ejection device designed for injection of a bioorganic material to manufacture biochips, and a liquid ejection device designed as a precision pipette for injection of a sample liquid. Other examples of the liquid ejection device include a liquid ejection device designed for pinpoint ejection of lubricating oil to an object precision machine, such as a watch or a camera, a liquid ejection device designed for ejection of a transparent resin solution of, for example, an ultraviolet curable resin, onto a substrate to manufacture a hemispherical microlens (optical lens) used for an optical communication element, and a liquid ejection device designed for ejection of an acid or alkali etching solution to etch a substrate. The principle of the invention is applicable to any of these liquid ejection devices and corresponding liquid containers.

The embodiment, its applications, and its modified examples discussed above are to be considered in all aspects as illustrative and not restrictive. The present invention may be embodied in other specific forms with some modifications, changes, and alterations without departing from the scope or spirit of the main characteristics of the present invention. The above embodiment and its modified examples describe the ink cartridge and the remanufacturing method of the ink cartridge as typical examples of the liquid container and the remanufacturing method of the liquid container. The principle of the invention is also actualized by a liquid refilling method and a liquid container used for the liquid refilling method. The technique of the invention is not restricted to the ink cartridge attached to the ink-jet printer but is also applicable to a liquid container designed to be attachable to and detachable from any of various liquid consuming devices and to store a liquid other than the ink. Typical examples of the liquid stored in such a liquid container include a dispersion or a solution of a material like an electrode material or a coloring material used to manufacture liquid crystal displays, el (electroluminescence) displays, surface-emitting displays, and color filters, a liquid of a bioorganic material used to manufacture biochips, a sample liquid used for precision pipettes, lubricating oil used for pinpoint ejection to an object precision machine, such as a watch or a camera, a transparent resin solution of, for example, an ultraviolet curable resin ejected onto a substrate to manufacture a hemispherical micro-lens (optical lens) used for an optical communication element, and an acid or alkali etching solution used to etch a substrate.

What is claimed is:

1. A method for remanufacturing a liquid container constructed to store a liquid, which is to be supplied to a liquid ejection device, the remanufacturing method comprising:

(a) providing a liquid container comprising: a liquid reservoir assembly configured to store a supply of a liquid, a liquid feeder configured to supply the liquid from the liquid reservoir assembly to the liquid ejection device and a liquid pathway for the passage of the liquid downstream from the liquid reservoir assembly to the liquid feeder; a sensor unit located at a position between the liquid reservoir assembly and the liquid feeder, the sensor unit configured to detect a level of the liquid stored in the liquid container; and a bubble trap module located at a position between the liquid reservoir assembly and the sensor unit and configured to trap bubbles included in the liquid;

(b) forming an inlet on the bubble trap module or on the portion of the liquid pathway from the bubble trap module to the liquid feeder, to be open to the outside of the liquid container;

(c) injecting the liquid through the inlet; and (d) sealing the inlet after the injection of the liquid.

2. The remanufacturing method in accordance with claim 1, wherein the step (a) provides the liquid container structured to further include: a connection flow path arranged to have an upstream section connecting with the liquid reservoir assembly and a downstream section connecting with the bubble trap module and defined by multiple through holes formed to pass through a container body of the liquid container from one face to the other face and have ends respectively interconnected and by films designed to seal both ends of the multiple through holes.

3. The remanufacturing method in accordance with claim 2, wherein the multiple through holes defining the connection flow path are formed in the step (a) to have a turndown like a dog-leg stair from upstream to downstream of the connection flow path.

4. The remanufacturing method in accordance with claim 3, wherein the multiple through holes are formed in the step (a) to be extended in a substantially horizontal direction and to be arranged in zigzag along a vertical direction in a state of attachment of the liquid container to the liquid ejection device.

5. The remanufacturing method in accordance with claim 1, wherein the step (a) provides the liquid container structured to further include: an air open structure located in the upstream of the liquid reservoir assembly and formed to introduce the outside air to inside of the liquid container accompanied with consumption of the liquid stored in the liquid reservoir assembly, and the step (c) sucks the air through the air open structure out of the liquid reservoir assembly.

6. The remanufacturing method in accordance with claim 1, wherein the step (c) sucks the air through the liquid feeder out of the liquid reservoir assembly.

7. The remanufacturing method in accordance with claim 1, wherein the step (a) provides the liquid container structured to further include: a backflow check structure located at a specific position between the sensor unit and the liquid feeder and configured to prevent backflow of the liquid toward the sensor unit, the step (b) forms the inlet to communicate either with the bubble trap module or with a pathway of the liquid extended from the bubble trap module to the backflow check structure, and the step (c) injects the liquid through the inlet to a specific position between the bubble trap module and the backflow check structure, the remanufacturing method further comprising:

(e) sucking in the liquid feeder to fill a space from the backflow check structure to the liquid feeder with the liquid.

8. The remanufacturing method in accordance with claim 1, wherein the step (a) provides the liquid container structured to further include: a buffer module located in a pathway from the sensor unit to the liquid feeder and configured to temporarily reserve the liquid, and the step (b) forms the inlet to communicate with the buffer module.

9. The remanufacturing method in accordance with claim 1, wherein the step (d) seals the inlet by insertion of an elastic member into the inlet.

10. The remanufacturing method in accordance with claim 1, wherein the step (a) provides the liquid container structured to further include: a cover member configured to cover over a wall surface defining either the bubble trap module or the pathway of the liquid provided at the specific position between the bubble trap module and the liquid feeder, the step (b) comprising:

(b1) forming a hole in the cover member to be greater in dimensions than the inlet; and (b2) forming the inlet in the wall surface.

11. The remanufacturing method in accordance with claim 1, wherein the step (a) provides the liquid container structured to further include: a memory configured to store information on a consumed amount of the liquid stored in the liquid container, the remanufacturing method further comprising:

(f) rewriting the information on the consumed amount of the liquid stored in the memory.

12. The remanufacturing method in accordance with claim 1, wherein the step (a) provides the liquid container structured to further include: a memory configured to store information on a consumed amount of the liquid stored in the liquid container, the remanufacturing method further comprising:

(g) replacing the memory.

13. A liquid container constructed to store a liquid, which is to be supplied to a liquid ejection device, the liquid container comprising:

a liquid reservoir assembly configured to store the liquid;

a liquid feeder configured to supply the liquid to the liquid ejection device;

a liquid pathway configured to supply the liquid downstream from the liquid reservoir assembly to the liquid feeder;

a sensor unit located at a specific position between the liquid reservoir assembly and the liquid feeder and configured to detect a level of the liquid stored in the liquid container;

a bubble trap module located at a specific position between the liquid reservoir assembly and the sensor unit and configured to trap bubbles included in the liquid;

an inlet formed on the bubble trap module or on the portion of the liquid pathway from the bubble trap module to the liquid feeder and configured to allow external injection of the liquid; and a sealing member structured to seal the inlet.

14. A liquid container constructed to be attachable to and detachable from a liquid ejection device and to store a liquid, which is to be supplied to the liquid ejection device, the liquid container comprising:

a liquid reservoir assembly configured to store the liquid;

a liquid feeder configured to supply the liquid to the liquid ejection device;

a liquid pathway configured to supply the liquid downstream from the liquid reservoir assembly to the liquid feeder, a sensor unit located at a specific position in a pathway of the liquid between the liquid reservoir assembly and the liquid feeder and configured to detect a level of the liquid stored in the liquid container; and a bubble trap module located at a specific position between the liquid reservoir assembly and the sensor unit and configured to trap bubbles included in the liquid, an inlet formed on the bubble trap module or the portion of the liquid pathway from the bubble trap module to the liquid feeder, the inlet configured to be open to the outside of the liquid container; and a sealing member structured to seal the inlet;

wherein the bubble trap module is filled with a specific amount of the liquid that enables bubbles that migrated into the bubble trap module to be trapped therein.

* * * * *